US011203454B2

(12) United States Patent
Takada et al.

(10) Patent No.: US 11,203,454 B2
(45) Date of Patent: Dec. 21, 2021

(54) MEDICINE DISPENSING DEVICE

(71) Applicant: YUYAMA MFG. CO., LTD., Toyonaka (JP)

(72) Inventors: Yasuyuki Takada, Toyonaka (JP); Takashi Iwatani, Toyonaka (JP); Takafumi Imai, Toyonaka (JP); Jun Horii, Toyonaka (JP)

(73) Assignee: YUYAMA MFG. CO., LTD., Toyonaka (JP)

( * ) Notice: Subject to any disclaimer, the term of this patent is extended or adjusted under 35 U.S.C. 154(b) by 416 days.

(21) Appl. No.: 16/337,362

(22) PCT Filed: Jul. 25, 2017

(86) PCT No.: PCT/JP2017/026894
§ 371 (c)(1),
(2) Date: Jun. 7, 2019

(87) PCT Pub. No.: WO2018/021323
PCT Pub. Date: Feb. 1, 2018

(65) Prior Publication Data

US 2019/0291911 A1 Sep. 26, 2019

(30) Foreign Application Priority Data

Jul. 29, 2016 (JP) ..... JP2016-150146

(51) Int. Cl.
*B65B 57/02* (2006.01)
*A61J 1/03* (2006.01)
(Continued)

(52) U.S. Cl.
CPC ..... *B65B 57/02* (2013.01); *A61J 1/03* (2013.01); *A61J 3/00* (2013.01); *A61J 7/02* (2013.01);
(Continued)

(58) Field of Classification Search
CPC ..... B65B 5/103; B65B 57/02; B65B 7/164; A61J 1/03; B65C 3/08; B65C 9/46
See application file for complete search history.

(56) References Cited

U.S. PATENT DOCUMENTS 5,946,883 A * 9/1999 Yuyama ..... B65B 5/103 53/154
6,119,737 A * 9/2000 Yuyama ..... B65G 47/1478 141/104
(Continued)

FOREIGN PATENT DOCUMENTS

CN 101257882 A 9/2008
CN 103501752 A 1/2014
(Continued)

OTHER PUBLICATIONS

JPO, Japanese Office Action dated Apr. 9, 2021 in Japanese Application No. 2018-529919, with English translation 6 pages.
(Continued)

*Primary Examiner* — Andrew M Tecco
(74) *Attorney, Agent, or Firm* — Masuvalley & Partners; Peter R. Martinez

(57) ABSTRACT

Provided is a medicine dispensing device having a container stocking portion) for stocking a plurality of medicine containers, a medicine supplying part for supplying solid medicines, container taking means for taking the container from the container stocking portion, a medicine filling part for filling the medicine container with the solid medicines supplied from the medicine supplying part and container checking means. The medicine checking means has posture keeping means for keeping a constant posture of the medicine container and a measuring member which can approach to and move away from the medicine container. The container checking means can check a type of the medicine container by holding the medicine container with keeping
(Continued)

the constant posture by using the posture keeping means and allowing the measuring member to approach to the medicine container from a remote position and make contact with the medicine container.

15 Claims, 27 Drawing Sheets

(51) Int. Cl.

| | |
|---|---|
| ***A61J 7/02*** | (2006.01) |
| ***B65B 1/04*** | (2006.01) |
| ***B65B 7/16*** | (2006.01) |
| ***B65C 3/08*** | (2006.01) |
| ***B65C 9/18*** | (2006.01) |
| ***B65C 9/46*** | (2006.01) |
| ***A61J 3/00*** | (2006.01) |
| ***B65B 1/30*** | (2006.01) |

(52) U.S. Cl.

CPC ..... *B65B 1/04* (2013.01); *B65B 1/30* (2013.01); *B65B 7/164* (2013.01); *B65C 3/08* (2013.01); *B65C 9/1865* (2013.01); *B65C 9/46* (2013.01); *A61J 2200/70* (2013.01); *A61J 2205/30* (2013.01)

(56) References Cited

U.S. PATENT DOCUMENTS

| | | | | |
|---|---|---|---|---|
| 6,519,913 | B2 * | 2/2003 | Higashizaki | B65B 7/2835 53/331.5 |
| 2006/0243738 | A1 | 11/2006 | Yuyama et al. | |
| 2007/0169838 | A1 * | 7/2007 | Yuyama | G07F 17/0092 141/107 |
| 2009/0235614 | A1 * | 9/2009 | Yuyama | B65B 5/103 53/167 |
| 2010/0251667 | A1 | 10/2010 | Yuyama et al. | |
| 2013/0284755 | A1 * | 10/2013 | Yuyama | A61J 7/0076 221/13 |
| 2013/0334242 | A1 * | 12/2013 | Yuyama | A61J 7/0084 221/7 |
| 2016/0193113 | A1 | 7/2016 | Jacobs et al. | |
| 2016/0343151 | A1 * | 11/2016 | Koike | A61J 7/0084 |

FOREIGN PATENT DOCUMENTS

| | | | | |
|---|---|---|---|---|
| DE | 10009562 | A1 * | 9/2001 | G01M 3/3281 |
| JP | H07-196129 | A | 8/1995 | |
| JP | H10-33636 | A | 2/1998 | |
| JP | H11-70901 | A | 3/1999 | |
| JP | 2004-168427 | A | 6/2004 | |
| JP | 2005/011563 | A1 | 2/2005 | |
| JP | 2005-211541 | A | 8/2005 | |
| JP | 2007-075178 | A | 3/2007 | |
| JP | 2009/020032 | A1 | 2/2009 | |
| JP | 2010-115339 | A | 5/2010 | |
| JP | 2013-013777 | A | 1/2013 | |
| WO | 2005/011563 | A1 | 2/2005 | |
| WO | 2009/020032 | A1 | 2/2009 | |
| WO | WO 2015/021445 | A1 | 2/2015 | |
| WO | 2015/119055 | A1 | 8/2015 | |

OTHER PUBLICATIONS

ISA/JP, International Search Report dated Oct. 31, 2017 in International Application No. PCT/JP2017/026894, Total 4 pages.

CNIPA, Chinese Office Action dated Dec. 16, 2020 in Chinese Application No. 201780030439.0, 12 pages.

Office Action issued in JP2018-529919 dated Sep. 9, 2021 (6 pages).

* cited by examiner

FIG. 26A
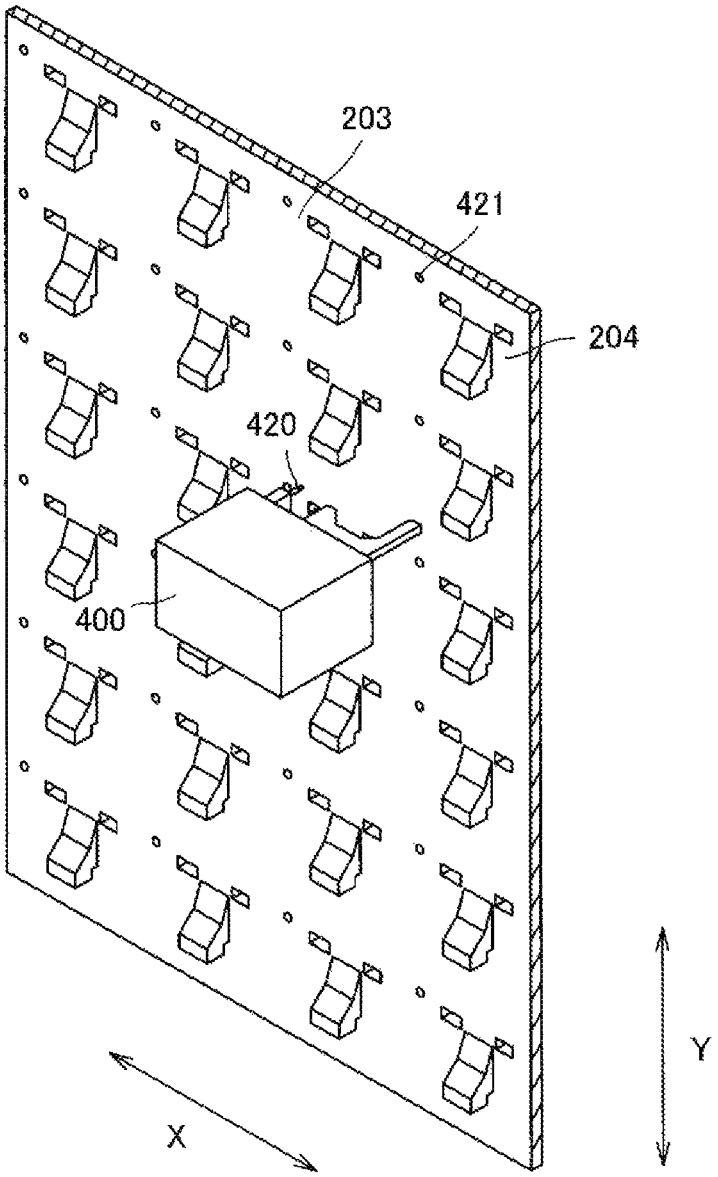
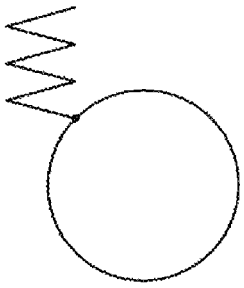
FIG. 26B
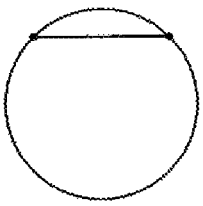
FIG. 26C
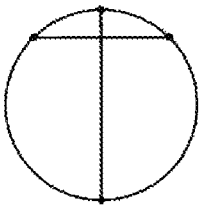
FIG. 26D
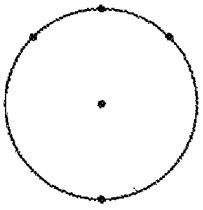
FIG. 26E

MEDICINE DISPENSING DEVICE

RELATED APPLICATIONS

This application is the U.S. National Phase of and claims priority to International Patent Application No. PCT/JP2017/026894, International Filing Date Jul. 25, 2017, which claims benefit of Japanese Patent Application No. 2016-150146 filed Jul. 29, 2016; both of which are incorporated herein by reference in their entireties.

TECHNICAL FIELD

The present invention relates to a medicine dispensing device having a function of filling a medicine container such as a vial bottle with solid medicines such as tablets and capsules.

BACKGROUND ART

A vial bottle is a container with a cover into which solid medicines such as tablets and capsule agents. In a hospital or a drug store, tablets or the like appropriate to a patient are filled in the vial bottle and the vial bottle is passed to the patient or an attendant.

Generally, work for filling the vial bottle with the medicines is manually performed by a pharmacist. Namely, the pharmacist selects the medicines from a large variety of stocked medicines based on prescription, counts the number of the selected medicines, fills the vial bottle with the selected medicines, putting the cover on the vial bottle so as to prevent the medicines from falling down from the vial bottle and then passes the vial bottle to the patient.

However, the work for manually selecting the medicines and filling the vial bottle with the medicines is burdensome work. Thus, each of patent documents 1: WO 2005/011563, 2: WO 2009/020032 has suggested a medicine dispensing device which can automatically perform a sequence of work from the work for selecting the medicines to the work for filling the vial bottle with the medicines.

SUMMARY OF THE INVENTION

A medicine dispensing device disclosed in the patent document 2 has a medicine supplying part, a container stocking portion, a vial bottle transferring part and a vial bottle cover fastening part.

The container stocking portion is a portion for stocking a bottle main body of the vial bottle which is a tablet container. The medicine supplying part includes a medicine storing portion and medicine taking means. A number of medicine stocking containers are attached to the medicine supplying part.

In the medicine dispensing device disclosed in the patent document 2, the bottle main body of the vial bottle is taken from the container stocking portion and then the bottle main body is transferred to a medicine filling part located in the vicinity of the medicine supplying part by a vial bottle transferring part. Then, medicines in a medicine storing portion are taken by the medicine taking means and then the medicines are filled into the bottle main body.

By the way, there are various vial bottles having different sizes and the vial bottles are properly used according to the amount of the medicines to be filled. Vial bottles generally used are a 30 mm opening vial bottle and a 40 mm opening vial bottle. Further, various vial bottles having different heights are available in the market.

Thus, for example, the medicine dispensing device disclosed in the patent document 2 includes a 30 mm opening container stocking portion for stocking the 30 mm opening vial bottle and a 40 mm opening container stocking portion for stocking the 40 mm opening vial bottle.

A user preliminary puts purchased vial bottles in predetermined container stocking portions for each size. Namely, the 30 mm opening vial bottles are stocked in the 30 mm opening container stocking portion and the 40 mm opening vial bottles are stocked in the 40 mm opening container stocking portion.

However, shapes of the 30 mm opening vial bottle and the 40 mm opening vial bottle are similar to each other. Thus, when the user picks up one vial bottle, there is a case where the user confuses that this vial bottle has which size.

As a result, there is a case where the user mistakenly puts the vial bottle into the inappropriate container stocking portion.

The bottle main body of the vial bottle contained in the inappropriate container stocking portion is transferred to the medicine filling part located in the vicinity of the medicine supplying part by the vial bottle transferring part and then the tablets are filled in the bottle main body.

Here, in the case where the 30 mm opening vial bottle is mistakenly put in the 40 mm opening container stocking portion, there is a case where all of the tablets cannot be contained in the vial bottle and some of the tablets fall down from the vial bottle.

On the other hand, the 40 mm opening vial bottle is mistakenly put in the 30 mm opening container stocking portion, there is a case where a few of tablets are put on a bottom of the vial bottle and there is a concern that the patient feels a sense of distrust.

In view of the described problem of the prior art, the present invention is intended to develop a medicine dispensing device having a function of determining a type of the medicine container such as the vial bottle.

An aspect for solving the described problem is a medicine dispensing device for dispensing a medicine container in which medicines are filled, the medicine dispensing device having a container stocking portion for stocking a plurality of medicine containers, a medicine supplying part for supplying solid medicines, container taking means for taking the container from the container stocking portion and a medicine filling part for filling the medicine container with the solid medicines supplied from the medicine supplying part, the medicine dispensing device comprising: container checking means for checking a type of the medicine container, wherein the container checking means has posture keeping means for keeping a constant posture of the medicine container and a measuring member which can approach to and move away from the medicine container, and wherein the medicine checking means can check the type of the medicine container by holding the medicine container with keeping the constant posture by using the posture keeping means and allowing the measuring member to approach to the medicine container from a remote position and make contact with the medicine container.

In the described aspect, it is preferable that the measuring member is a height measuring member and the height measuring member is approached to the medicine container from the remote position so that the height measuring member makes contact with one end of the medicine container.

In the described aspect, it is preferable that the height measuring member has a protruding portion protruding toward the side of the medicine container, and the height measuring member can check difference between an opening side and a bottom side of the medicine container depending on whether or not the protruding portion makes contact with the medicine container by holding the medicine container with keeping the constant posture by using the posture keeping means and allowing the height measuring member to approach to the medicine container from the remote position and make contact with the medicine container.

In each of the described aspects, it is preferable that the medicine dispensing device further comprises au outer periphery holding member for holding an outer peripheral portion of the medicine container, the outer periphery holding member has an outer diameter measuring member which can approach to and move away from the outer peripheral portion of the medicine container, and the medicine dispensing device can check the type of the medicine container by allowing the outer diameter member to approach to the medicine container from the remote position and make contact with the outer peripheral portion of the medicine container.

In each of the described aspects, it is preferable that the medicine dispensing device further comprises a plurality of detection sensors respectively arranged at positions apart from the side of one end of the medicine container toward a height direction of the medicine container and the medicine dispensing device can check a height of the medicine container from detecting status of the detection sensors.

In each of the described aspects, it is preferable that the medicine dispensing device further comprises an installation base on which the medicine container taken by the container taking means and position correcting means for correcting a position of the medicine container placed on the installation base to a normal position, a bottom portion of the medicine container is placed on the installation base, the position correcting means has holding means constituted of a plurality of holding pieces, each of the plurality of holding pieces has a concave portion which can make contact with an outer peripheral portion of the medicine container, a central portion of an area surrounded by each of the concave portions substantially coincides with a central portion of the medicine container arranged at a normal set position in a state that the holding pieces move or change their postures and each of the holding pieces moves to an approaching and moving away direction and thereby the holding pieces approach to each other, the holding pieces of the position correcting means move in the approaching direction after the medicine container has been placed on the installation base and thereby the concave portions make contact with the outer peripheral portion of the medicine container to shift the position of the medicine container for correcting the position of the medicine container to the normal position, and after the position of the medicine container has been corrected, the holding pieces move away from the outer peripheral portion of the medicine container and leave from the outer peripheral portion of the medicine container.

In each of the described aspects, it is preferable that the medicine dispensing device further comprises a container inside photographing camera for photographing an inside of the medicine container in a state that the medicines are filled in the medicine container and the medicine dispensing device has a focus correcting function of correcting focus of the container inside photographing camera based on the amount of the medicines filled in the medicine container.

In each of the described aspects, it is preferable that the medicine container has an opening portion, the medicine dispensing device further comprises a sealing device for covering the opening portion with a sheet, the sealing device has sheet delivering means for delivering the sheet by a required amount from a longitudinal sheet, a plurality of heat-sealing heads and a movable table on which the plurality of heat-sealing heads are placed, and suitable one of the heat-sealing heads is selected based on an opening diameter of the medicine container, the movable table is driven to move the selected heat-sealing head to the vicinity of the medicine container and then the sheet is put between the selected heat-sealing heat and the opening portion of the medicine container for attaching the sheet to the opening portion of the medicine container.

In each of the described aspects, it is preferable that the medicine container has an opening portion, the medicine dispensing device further comprises a sealing device for covering the opening portion with a sheet and sealing checking means, and the sealing checking means has a temporary pressing member for pressing the opening portion of the medicine container after sealing and determines whether or not the sealing is performed based on behavior of the temporary pressing member.

In each of the described aspects, it is preferable that the medicine dispensing device further comprises a labeling device for attaching a label on which predetermined matters are written to the medicine container, the labeling device has a label printing part and base paper supplying means for supplying label paper to the label printing part, each piece of the label paper is stripped off from a paper roll constituted of a longitudinal release sheet to which a number of pieces of label paper adhere, the base paper supplying means has a delivering side attachment shaft to which a paper roll in a state of having the label paper is attached and a rolling side attachment shaft for rolling the release sheet after the label paper has been stripped off, and a core which can change a diameter of at least one of the delivering side attachment shaft and the rolling side attachment shaft can be attached to the at least one of the delivering side attachment shaft and the rolling side attachment shaft.

In each of the described aspects, it is preferable that the medicine dispensing device further comprises a labeling device for attaching a label on which predetermined matters are written to the medicine container, the labeling device has a label printing part and base paper supplying means for supplying label paper to the label printing part, each piece of the label paper is stripped off from a paper roll constituted of a longitudinal release sheet to which a number of pieces of label paper adhere, the base paper supplying means has a delivering side attachment shaft to which a paper roll in a state of having the label paper is attached and a rolling side attachment shaft for rolling the release sheet after the label paper has been stripped off, and the delivering side attachment shaft is rotated within a predetermined range of force by driving force.

In each of the described aspects, it is preferable that the medicine dispensing device further comprises a labeling device for attaching a label on which predetermined matters are written to the medicine container, the labeling device has a label printing part, base paper supplying means for supplying label paper to the label printing part and label stripping means, each piece of the label paper is stripped off from a label sheet constituted of a longitudinal release sheet to which a number of pieces of label paper adhere, the label sheet is delivered from a paper roll rolled in a roll shape to the label printing part through a predetermined label supplying path, and a pressing member for pressing one side of the label sheet facing an outer side of the paper roll to warp the label sheet toward a direction opposite to a curl direction of the paper roll is provided at an upper stream position than the label stripping means in the label supplying path.

In each of the described aspects, it is preferable that the medicine container has a main body portion and a cover, a screw is provided on the cover of the main body, the medicine dispensing device further comprises a cover attaching device for attaching the cover to the medicine container, and the cover attaching device once rotates the cover in an opening direction after pressing the cover onto an opening portion of the main body portion of the medicine container and then rotates the cover in a fastening direction.

In each of the described aspects, it is preferable that the container stocking portion has a container storing box including a storing space for storing the container and a lifting device for taking the container from the container storing box, the lifting device has an endless member, the endless member has an engaging portion engaged with the container, the lifting device has a loading port portion arranged in the vicinity of a bottom portion of the container storing box and an unloading port portion provided on the upper side, one surface of the endless member runs from the loading port portion toward the unloading port portion, feeding means which can move the container in the storing space in one direction is provided on an inside bottom portion of the storing space, the loading port portion of the lifting device is located on the lateral side of the feeding member in the vicinity of an end of a feeding direction of the container in the storing space, and an introducing member for changing a moving direction of the container to introduce the container to the loading port portion is provided in the vicinity of the end of the feeding direction of the container in the storing space.

In each of the described aspects, it is preferable that the medicine dispensing device further comprises a medicine cassette and storage means in which information on a length of the medicine is stored, the medicine cassette is arranged at the medicine supplying part, the medicine cassette has a solid agent containing portion for containing the solid medicines, a discharge port for discharging the solid medicines from the solid agent containing portion and a rotating body and is configured to rotate the rotating body to move the solid medicines to the discharging port, and a rotational speed of the rotating body is decided based on the length of the medicine stored in the storage means.

In each of the described aspects, it is preferable that the medicine supplying part contains a medicine cassette and medicine counting means, the medicine cassette has a solid agent containing portion for containing the solid medicines and is configured to discharge the solid medicines in the solid agent containing portion one by one, the medicine counting means is configured to count the number of the solid medicines discharged from the medicine cassette and has a plurality of light emitting members arranged so as to be separated from each other by a predetermined distance and a plurality of light receiving members, and the plurality of light emitting members are grouped into a plurality of emitting member groups and light emitting amounts of the plurality of light emitting members are controlled for each emitting member group.

Since the medicine dispensing device of the present invention has the function of determining the type of the medicine container such as a vial bottle, it is possible to solve an error caused by mismatching of a container size or the like.

BRIEF DESCRIPTION OF THE DRAWINGS

FIGS. 6A and 6B show a case where a vial bottle is placed with a normal posture and FIG. 6C shows a case where the vial bottle is placed upside down.

FIG. 7A shows a state that a cover is removed and FIG. 7B shows a state that the cover is attached.

FIG. 10A shows a case where a sheet roll whose core has a large diameter and FIG. 10B shows a case where a sheet roll whose core has a small diameter or which has no core is used.

FIG. 20A shows a case where a resin sheet is properly attached to an opening of the vial bottle and FIG. 20B shows a case where the resin sheet is broken or loosened.

FIG. 21A shows a case of using a vial bottle whose height is high and FIG. 21B shows a case of using a vial bottle whose height is low.

FIG. 26A is a perspective view obtained by observing a rear side of a medicine supplying part in the medicine dispensing device shown in FIG. 1. FIGS. 26B to 26E are explanation views for explaining operations at the time of positioning a movable head and showing a detected position of a sensor target in each phase.

Figure 1:
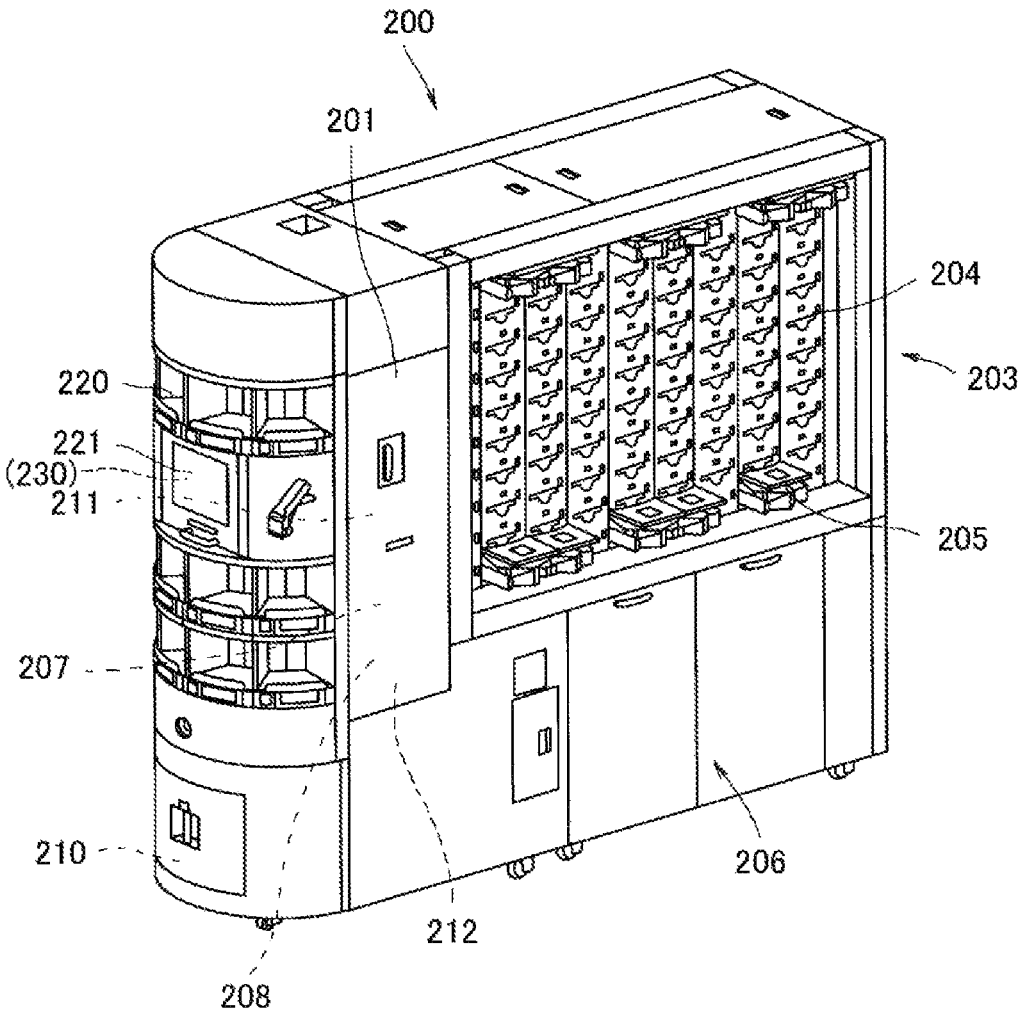
FIG. 1 is a perspective view of a medicine dispensing device according to an embodiment of the present invention.

Hereinafter, description will be further given to an embodiment of the present invention.

First, an outline of a medicine dispensing device 200 is explained.

The medicine dispensing device 200 according to this embodiment has a function of selecting a specific type of solid medicines from a variety of types of solid medicine groups and filling a vial bottle 2 with the selected solid medicines. The solid medicine is a collective term for a tablet, a capsule and the like. Although a case where tablets are used is explained in the following description, the medicine dispensing device 200 according to this embodiment is not limited to the intended use for dispensing the tablets and may be used for dispensing solid medicines other than the tablets.

The medicine dispensing device 200 according to this embodiment includes a storage shelf 220 and a monitor screen 221, which is a displaying part, on the front side thereof. Further, a control device 230 is provided on the rear side of the monitor screen 221.

A medicine supplying part 203 is provided on the lateral side of the medicine dispensing device 200. Further, container stocking portions 206, a medicine transferring device 212, vial bottle transferring means 207, a vial bottle checking portion 208, a labeling portion 210 and a sealing portion 211 are provided in the medicine dispensing device 200. In FIG. 1, for built-in objects, only positions of the built-in objects are indicated by reference numbers.

The medicine supplying part 203 includes a medicine storing portion and medicine dispensing means. A plurality of container attachment portions 204 are provided in the medicine supplying part 203. Further, medicine stocking containers 205 are respectively attached to the container attachment portions 204. In this regard, although FIG. 1 shows a state that the medicine stocking containers 205 are attached to only the container attachment portions 204 at the lowest line, the medicine dispensing device 200 is used in a state that the medicine stocking containers 205 are attached to all surfaces of the medicine supplying part 203 in actuality.

Different types of tablets are stocked in each medicine stocking container 205.

The medicine stocking container 205 and the medicine dispensing mean employed in this embodiment are an after-mentioned medicine cassette 310 and is configured to discharge solid medicines such as tablets and capsules by a desired amount.

The medicine transferring device 212 is configured to hold a main body portion of the vial bottle 2, transfer the vial bottle 2 to the rear side of the container attachment portion 204, receive the tablets discharged from the medicine cassette 310 with the vial bottle 2 and move the vial bottle 2 filled with the tablets to the vial bottle checking portion 208.

The container stocking portion 206 is a portion for stocking a bottle main body portion of the vial bottle (hereinafter, referred to as a vial bottle 2, simply) which is a tablet container. In this embodiment, the number of the container stocking portions 206 is two. A 30 mm opening vial bottle is contained in one of the container stocking portions 206 and a 40 mm opening vial bottle is contained in the other one of the container stocking portions 206.

An after-mentioned empty container transferring device 6 is built in each of the container stocking portions 206. A number of vial bottles 2 are stocked in the container stocking portions 206 and the vial bottles 2 are taken from the container stocking portions 206 one by one.

An after-mentioned vial bottle checking device 1 is provided in the vial bottle checking portion 208. A size of the vial bottle 2 is checked by this device.

An after-mentioned labeling device 3 is provided in the labelling portion 210. A label on which a patient name, a medicine name and an image of medicine are drawn is made and attached the label to the vial bottle 2 by this device.

An after-mentioned sealing device 5 is provided in the sealing portion 211. An opening portion of the vial bottle 2 filled with the medicines is covered by a resin sheet by this device.

In the medicine dispensing device 200 according to this embodiment, a number of empty vial bottles 2 are contained in the empty container transferring device 6 of the container stocking portion 206. Then, one of the vial bottles 2 is taken by the empty container transferring device 6 and transferred to the vial bottle checking portion 208. In the vial bottle checking portion 208, a size of the vial bottle 2 is checked by the vial bottle checking device 1.

Further, the vial bottle 2 is transferred to the labeling portion 210. The label on which the patient name, the medicine name and the like are written is attached to a lateral surface of the vial bottle 2 by the labeling device 3.

After that, the empty vial bottle 2 is transferred to the vicinity of the rear side of the container attachment portion 204 by the vial bottle transferring means 207.

Then, the tablets in the medicine stocking container 205 are taken by the medicine dispensing means. The tablets are discharged from the rear side of the medicine attachment portion 204 and the tablets are supplied into the vial bottle 2.

As described above, the tablets are filled into the vial bottle 2.

After that, the vial bottle 2 filled with the tablets is transferred to the sealing portion 211. An inside of the vial bottle 2 is photographed and then the opening of the vial bottle 2 is sealed by the resin sheet.

Further, the vial bottle 2 is discharged to the storage shelf 220.

Next, description will be given to the devices built in the medicine dispensing device 200.

(Vial Bottle Checking Device 1)

Figure 2:
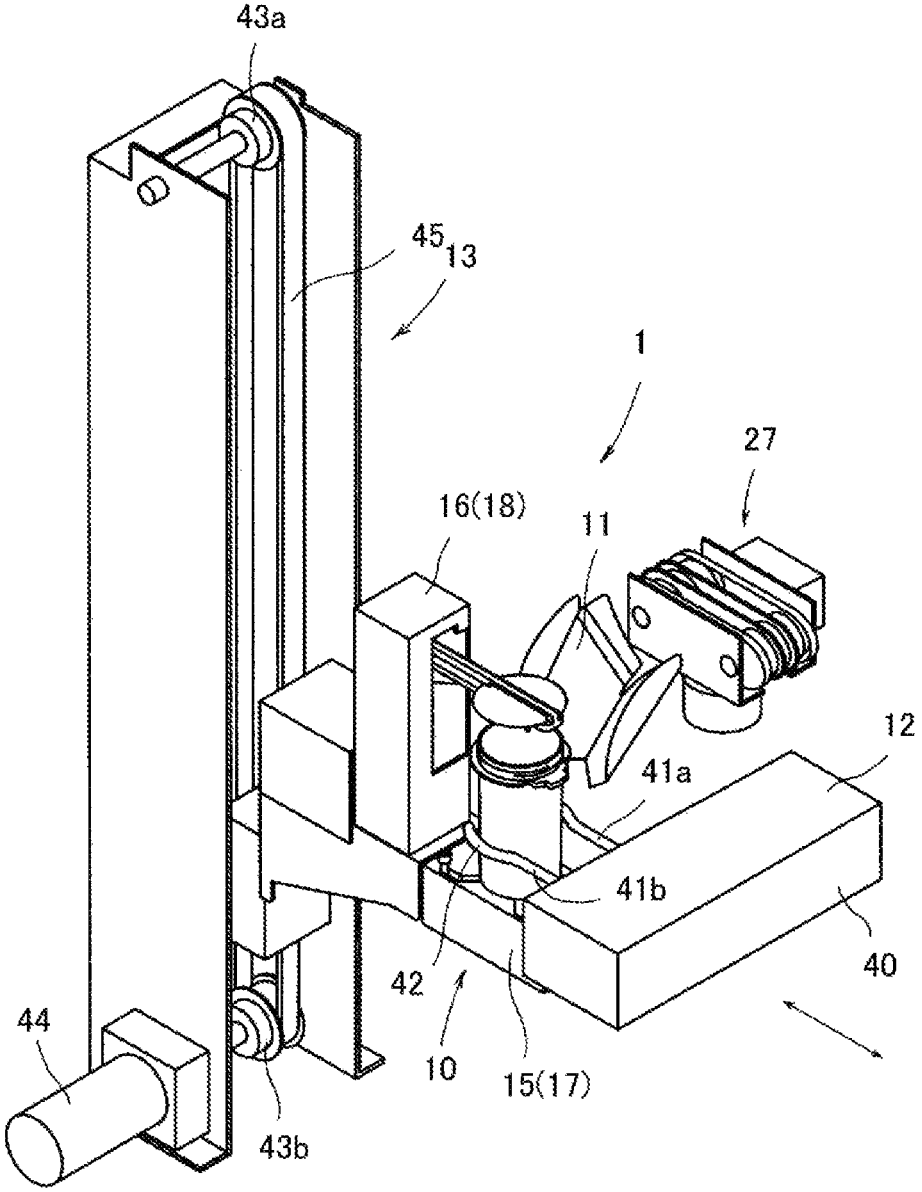
FIG. 2 is a perspective view of a vial bottle checking device built in the medicine dispensing device shown in FIG. 1.

The vial bottle checking device (container checking means) 1 is constituted of a main body device 10, a slope base 11 and a centering member 12 as shown in FIG. 2. Further, posture changing means 27 is provided in the vicinity of the vial bottle checking device 1.

Further, the vial bottle checking device 1 includes a raising and lowering device 13 for raising and lowering the main body device 10.

The main body device 10 is constituted of an installation base 15, a vertical wall portion 16, a motor 26 and a driving force branching portion 24.

An outer diameter measuring mechanism portion 17 for measuring an outer diameter of the vial bottle 2 is provided in the installation base 15. Further, a total height measuring mechanism portion 18 for measuring a height of the vial bottle is provided in the vertical wall portion 16.

The driving force branching portion 24 has one input shaft 170 and two output shafts 171, 172. Further, a gear train containing a bevel gear train 46 is provided in the driving force branching portion 24 and rotational force of the input shaft 170 is transmitted to the two output shafts 171, 172. In this embodiment, the one output shaft 171 is provided on an extension line of a rotational axis of the motor 26 and transmits the rotational force to the outer diameter measuring mechanism portion 17. The other output shaft 172 extends in a direction perpendicular to the rotational axis of the motor 26 and transmits the rotational force to the total height measuring mechanism portion 18.

A torque limiter (not shown) and an encoder 175 intervene between the output shaft 171 horizontally extending and the outer diameter measuring mechanism portion 17.

Thus, the rotational force is transmitted to the outer diameter measuring mechanism portion 17 within the limit of predetermined torque and the output shaft 171 idly rotates when a load exceeds a predetermined value.

The encoder 175 is attached to the side nearer to the outer diameter measuring mechanism portion 17 than the torque limiter and the rotational number transmitted to the outer diameter measuring mechanism portion 17 in actually is detected.

A torque limiter 176 and an encoder 177 intervene between the output shaft 172 vertically extending and the total height measuring mechanism portion 18.

Thus, the rotational force is transmitted to the total height measuring mechanism portion 18 within the limit of predetermined torque and the output shaft 172 idly rotates when a load exceeds a predetermined value.

The encoder 177 is attached to the side nearer to the total height measuring mechanism portion 18 than the torque limiter 176 and the rotational number transmitted to the total height measuring mechanism portion 18 in actually is detected.

Figure 3:
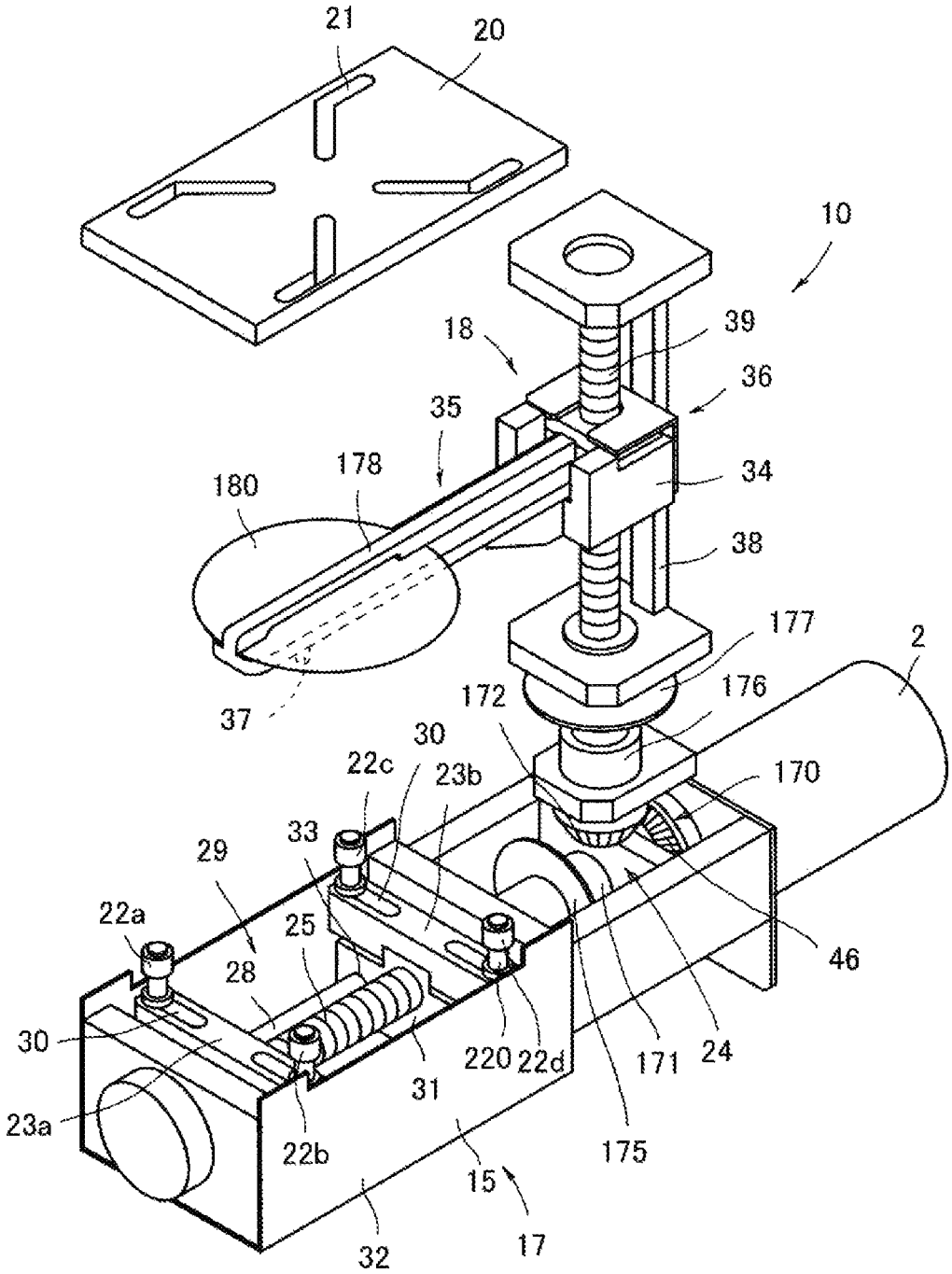
FIG. 3 is an exploded perspective view of an outer diameter measuring mechanism portion and a total height measuring mechanism portion of the vial bottle checking device shown in FIG. 2.

The installation base 15 of the main body device 10 is a base taking a horizontal posture and is constituted of a surface plate 20 and a mechanical portion 29 as shown in FIG. 3.

Four slits 21 are formed in the surface plate 20. The slits 21 form a shape radially with respect to the vicinity of a center of the surface plate 20.

The four slits 21 serve as a guide.

The mechanical portion 29 has a box portion 32 constituting an outer frame. Measuring pins 22*a*, 22*b*, 22*c*, 22*d*, pin moving members 23*a*, 23*b*, a ball screw 25 and a guide rod 28 are built in the box portion 32. In this embodiment, the measuring pins 22*a*, 22*b*, 22*c*, 22*d* serve as a measuring member which can approach to and move away from the medicine container. Further, in this embodiment, the measuring pins 22*a*, 22*b*, 22*c*, 22*d* also serve as posture keeping means for keeping a constant posture of the medicine container.

A direction of a spiral of the ball screw 25 is formed from a central portion of the ball screw 25 in the lengthwise direction thereof so as to be directed in an opposite direction. Namely, a portion from one end to the vicinity of the central portion has a right screw shape and a portion from the vicinity of the central portion to the other end has a left screw shape.

Slits 30 passing through in the vertical direction are respectively formed in the pin moving members 23*a*, 23*b*. Further, ball nuts (not shown) are respectively attached to the pin moving members 23*a*, 23*b*.

Further, a through-hole 33 passing through in the horizontal direction is formed at a position near to an end side of each of the pin moving members 23*a*, 23*b*.

Next, description will be given to relationships among each member in the outer diameter measuring mechanism portion 17.

The ball screw 25 is horizontally arranged at a center of the box portion 32. The guide rod 28 is arranged in parallel with the ball screw 25 through the ball screw 25.

Ball nuts 31 of the pin moving members 23*a*, 23*b* are engaged with the ball screw 25. Further, the through-holes 33 of the pin moving members 23*a*, 23*b* are engaged with the guide rod 28.

Two of the measuring pins 22*a*, 22*b*, 22*c*, 22*d* are inserted into each of the slits 30 of the pin moving member 23*a*, 23*b*. Further, the surface plate 20 is attached to the box portion 32 and each of the measuring pins 22*a*, 22*b*, 22*c*, 22*d* passes through one of the slits 21 formed in the surface plate 20.

Next, description will be given to operations of the outer diameter measuring mechanism portion 17.

When the motor 26 rotates, the ball screw 25 rotates and the pin moving members 23*a*, 23*b* and the ball nuts 31 engaged with the ball screw 25 move in the axial direction. In this regard, since the guide rod 28 is engaged with the pin moving members 23*a*, 23*b*, the pin moving members 23*a*, 23*b* parallel move along the guide rod 28.

Here, the portion of the ball screw 25 from the one end to the vicinity of the center has the right screw shape and the portion of the ball screw 25 from the vicinity of the center to the other end has the left screw shape. Thus, when the ball screw 25 rotates, the pin moving members 23*a*, 23*b* respectively move in different directions opposite to each other.

Namely, when the ball screw 25 rotates, the pin moving members 23*a*, 23*b* move in a direction so as to approach to each other or a direction so as to move away from each other.

As described above, two of the measuring pins 22*a*, 22*b*, 22*c*, 22*d* are inserted into each of the slits 30 of the pin moving member 23*a*, 23*b*. Here, the slits 30 of the pin moving members 23*a*, 23*b* extend in a direction perpendicular to the axial direction of the ball screw 25.

Thus, each of the measuring pins 22*a*, 22*b*, 22*c*, 22*d* has a degree of freedom in the direction perpendicular to the axial direction of the ball screw 25. On the other hand, the measuring pins 22*a*, 22*b*, 22*c*, 22*d* move in the axial direction of the ball screw 25 as the pin moving members 23*a*, 23*b* move.

Further, the measuring pins 22*a*, 22*b*, 22*c*, 22*d* are respectively engaged with the slits 21 formed in the surface plate 20 so as to extend in the radial direction.

Thus, when the pin moving members 23*a*, 23*b* move in the axial direction of the ball screw 25, the measuring pins 22*a*, 22*b*, 22*c*, 22*d* move along the slits 21 formed in the surface plate 20.

As described above, the four slits 21 are formed in the shape radially with respect the vicinity of the center of the surface plate 20. Further, the pin moving members 23*a*, 23*b* move in the direction for approaching to each other or in the direction for moving away from each other.

Thus, when the motor 26 is rotated to move the pin moving members 23*a*, 23*b* in the direction for approaching to each other, the measuring pins 22*a*, 22*b*, 22*c*, 22*d* respectively move along the four slits 21 all together toward the vicinity of the center of the surface plate 20 and gather at the vicinity of the center. As a result, a diameter of an inscribed circle of the measuring pins 22*a*, 22*b*, 22*c*, 22*d* is reduced. Since the rotational force of the motor 26 is transmitted to the ball screw 25 through the torque limiter, the rotation of the ball screw 25 stops when the measuring pins 22*a*, 22*b*, 22*c*, 22*d* make contact with an obstacle.

Inversely, when the motor 26 is rotated to move the pin moving members 23*a*, 23*b* in the direction for moving away from each other, the measuring pins 22*a*, 22*b*, 22*c*, 22*d* respectively move all together toward the outside. As a result, the diameter of the inscribed circle of the measuring pins 22*a*, 22*b*, 22*c*, 22*d* is increased.

Further, the rotational number of the ball screw 25 is detected by the encoder 175 and positions of the measuring pins 22*a*, 22*b*, 22*c*, 22*d* are computed. This makes it possible to obtain the diameter of the inscribed circle of the measuring pins 22*a*, 22*b*, 22*c*, 22*d*.

Next, description will be given to a configuration of the total height measuring mechanism portion 18 of the main body device 10.

As described in FIG. 3, the total height measuring mechanism portion 18 is constituted of a height measuring member 35 supported in a cantilever manner and a raising and lowering mechanism 36 for raising and lowering the height measuring member 35.

A main body portion 178 of the height measuring member 35 is a rod-like member. Further, a protruding portion 37 (see FIG. 3 and FIGS. 6A to 6C) is provided at a position slightly near to a base end side from a free end side on a lower surface of the height measuring member 35.

A thin plate-like temporary cover member 180 is provided on the main body portion 178 of the height measuring member 35. The temporary cover member 180 has a circular shape and keeps its horizontal posture. The temporary cover member 180 is a cover for preventing dusts from getting into the vial bottle 2.

The raising and lowering mechanism 36 has a ball screw 39 and a ball nut 34.

The ball screw 39 is held with a vertical posture and the rotational force is transmitted to the ball screw 39 from the output shaft 172 of the driving force branching portion 24.

The ball nut 34 is engaged with the ball screw 39. Further, the ball nut 34 is restricted by the guide 38 so that the ball nut 34 can parallel move in the vertical direction.

The height measuring member 35 is fixed to the ball nut 34.

In the total height measuring mechanism portion 18, when the motor 26 rotates, the ball screw 39 rotates and the ball nut 34 engaged with the ball screw 39 parallel moves in the vertical direction.

As a result, the height measuring member 35 is raised and lowered with keeping the horizontal posture.

Further, the rotational number of the ball screw 39 is detected by the encoder 177 and a position of the height measuring member 35 is detected based on the rotational number of the ball screw 39. This makes it possible to obtain a distance from the installation base 15 of the main body device 10 to the height measuring member 35.

The raising and lowering device 13 is constituted by bridging a belt 45 between upper and lower pulleys 43*a*, 43*b* as shown in FIG. 2. Further, the pulley 43*b* on the one side is rotated by a geared motor 44.

The above-mentioned main body device 13 is engaged with the belt 45 of the raising and lowering device 13 and the main body device 10 is raised and lowered by running the belt 45 of the raising and lowering device 13.

Next, description will be given to the centering member (position correcting means) 12.

The centering member 12 is a member in which a pair of centering arms 41*a*, 41*b* protrude from a box-like linearly moving member 40 in a cantilever manner.

Each of the centering arms 41*a*, 41*b* is a rod-like member having a curved portion 42 at the vicinity of a tip end (a free end side) thereof.

The centering arms 41*a*, 41*b* are attached to the linearly moving member 40 so that a plane defined by the curved portions 42 is defined as a plane for a horizontal posture thereof and concave portions of the curved portions 42 face each other.

An arm operation mechanism which is constituted of a motor and a gear train (not shown) is built in the linearly moving member 40. The centering arms 41*a*, 41*b* are swayed by the arm operation mechanism of the linearly moving member 40 around the base end portion and the two centering arms 41*a*, 41*b* are opened and closed in a state that the freedom end side keeps the horizontal posture. As a result, the curved portions 42 of the centering arms 41*a*, 41*b* approach to each other and move away from each other.

Further, the linearly moving member 40 is linearly moved by a linearly moving mechanism (not shown) with respect to the main body device 10 in the approaching and moving away direction as indicated in the arrow in FIG. 2.

The slope base 11 is a slope taking an inclined posture and its surface is curved. The slope base 11 is fixed at a constant height position. The slope base 11 has no driving source and is not raised and lowered.

Further, there are posture changing means 27 and a posture checking sensor (not shown) in a transferring path from the container stocking portion 206 to the slope base 11. The posture checking sensor is configured to distinguish between an opening side and a bottom side of the vial bottle 2. In this embodiment, a posture that the bottom side of the vial bottle 2 is positioned at the head position is a normal posture. The posture changing means 27 is configured to rotate the vial bottle 2 for changing the direction of the vial bottle 2 in a case where the posture of the vial bottle 2 is reversed back to front.

The posture changing means 27 is located at an upper end of the slope base 11 and the vial bottle 2 dispensed from container stocking portion 206 is transferred by a conveyer (not shown). If the posture of the vial bottle 2 is reversed back to front, the posture changing means 27 rotates the vial bottle 2 to correct the direction of the vial bottle 2.

In this embodiment, the posture of the vial bottle 2 is controlled by the posture checking sensor and the posture changing means 27 so that the bottom side of the vial bottle 2 is positioned on the lower side of the slope base 11.

Next, description will be given to a sequent of operations of the vial bottle checking device (container checking means) 1.

At a preparing phase, the main body device 10 of the vial bottle checking device (container checking means) 1 is held at an about middle level of height by the raising and lowering device 13.

In this state, a lower end of the slope base 11 is positioned in the vicinity of the installation base 15 of the main body device 10 as shown in FIG. 2.

The centering arms 41*a*, 41*b* of the centering member 12 is located at a position apart from the installation base 15.

With focusing on the installation base 15 of the main body device 10, the installation base 15 takes a state that the measuring pins 22*a*, 22*b*, 22*c*, 22*d* of the installation base 15 are positioned at a marginal portion apart from the center and the diameter of the inscribed circle of the measuring pins 22*a*, 22*b*, 22*c*, 22*d* is expanded.

Figure 4A:
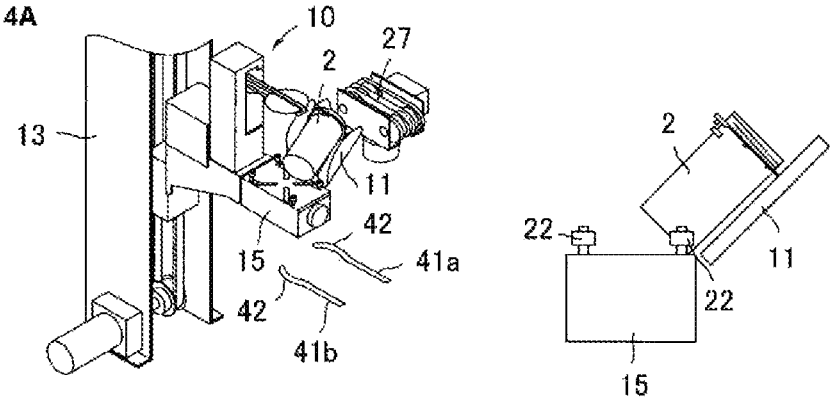
FIGS. 4A to 4D are perspective views and side views showing a sequence of operations of the vial bottle checking device.

As described above, the vial bottles 2 are stored in the container stocking portion 206 and one of the vial bottles 2 is taken and placed on the slope base 11 as shown in FIG. 4A. As described above, there are the posture checking sensor and the posture changing means 27 in the transferring path from the container stocking portion 206 to the slope base 11 and the direction of the vial bottle 2 is set so that the bottom side of the vial bottle 2 is positioned at the head position.

Thus, the posture of the vial bottle 2 placed on the slope base 11 is an inclined posture. In this state, the opening is on the upper side and the bottom is on the lower side.

Since the slope base 11 takes the inclined posture, the vial bottle 2 slides on the slope base 11 and a part of the bottom portion of the vial bottle 2 makes contact with the installation base 15 of the main body device 10 as shown in FIG. 4A.

The posture of the vial bottle 2 is the inclined posture as shown in FIG. 4A and the lateral surface on the upper side is supported by the slope base 11 and a part of the lower end makes contact with the installation base 15.

Figure 4B:
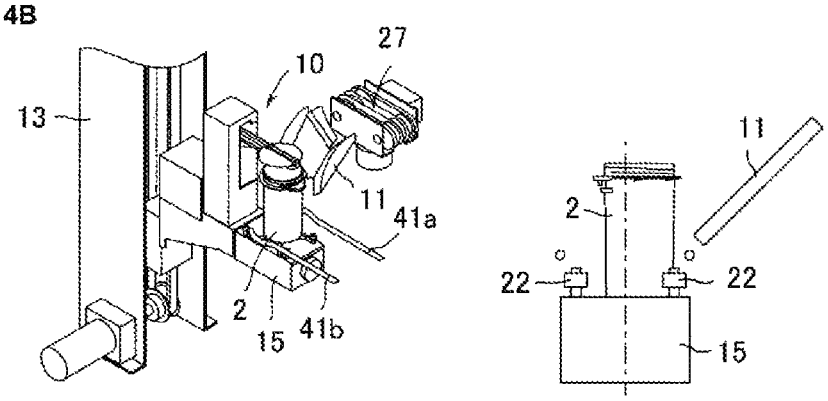

From this state, the raising and lowering device 13 is driven to slightly lower the main body device 10 as shown in FIG. 4B. Due to this operation, the lower portion of the slope base 11 is relatively moved along the lateral surface of the vial bottle 2 and the vial bottle 2 is swayed around a contact point between the installation base 15 and the vial bottle 2 to allow the vial bottle 2 to stand up.

Figure 4C:
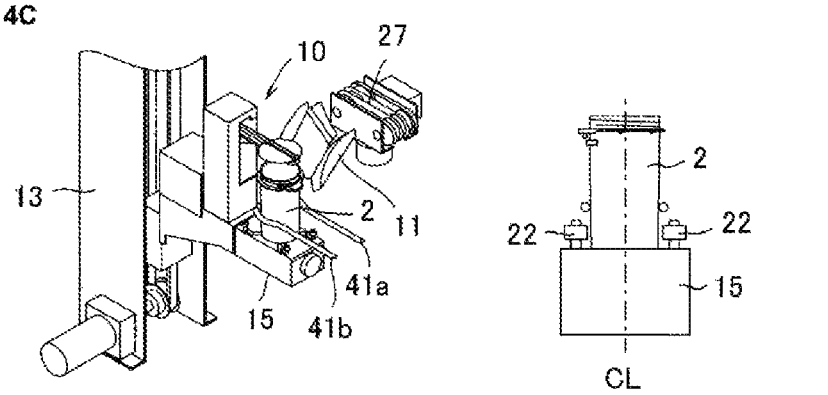

As a result, the vial bottle 2 takes a stand posture as shown in FIG. 4C. Further, in the vertical posture of the vial bottle 2, the opening is on the upper side and the bottom is on the lower side.

Figure 5A:
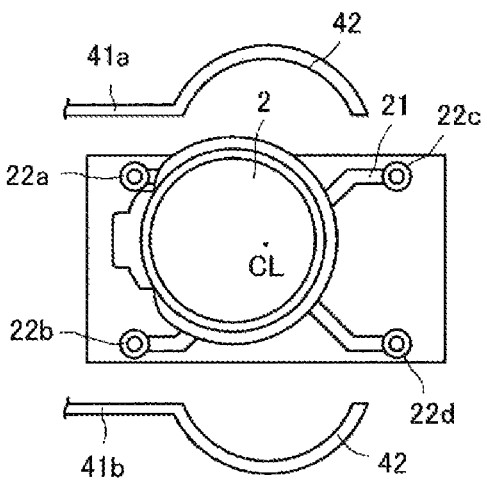
FIGS. 5A to 5D are perspective views showing operations of a centering arm and the outer diameter measuring mechanism portion of the vial bottle checking device shown in FIG. 2.

Further, at this time, the bottom of the vial bottle 2 is located within the inscribed circle of the measuring pins 22*a*, 22*b*, 22*c*, 22*d*. In this regard, a center of the vial bottle 2 is not necessarily positioned at a center CL of the inscribed circle of the measuring pins 22*a*, 22*b*, 22*c*, 22*d*. In many cases, the center of the vial bottle 2 is shifted from the center CL of the inscribed circle of the measuring pins 22*a*, 22*b*, 22*c*, 22*d* as shown in FIG. 4B and FIG. 5A.

Subsequently, the centering member 12 is moved toward the side of the main body device 10 and the vial bottle 2 is put into the curved portions 42 of the centering arms 41*a*, 41*b* facing each other. Then, the centering arms 41*a*, 41*b* are swayed in the closing direction.

Figure 5B:
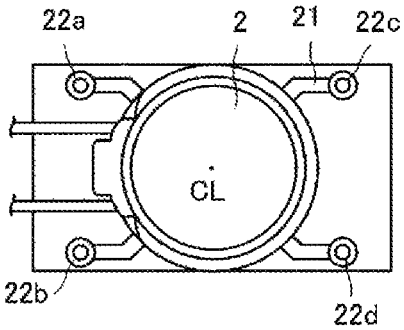

As a result, the lateral surface of the vial bottle 2 makes contact with the curved portions 42 of the centering arms 41*a*, 41*b* facing each other and the vial bottle 2 is pushed and moved toward the center CL of the inscribed circle of the measuring pins 22*a*, 22*b*, 22*c*, 22*d* as shown in FIG. 4C and FIG. 5B.

Figure 4D:
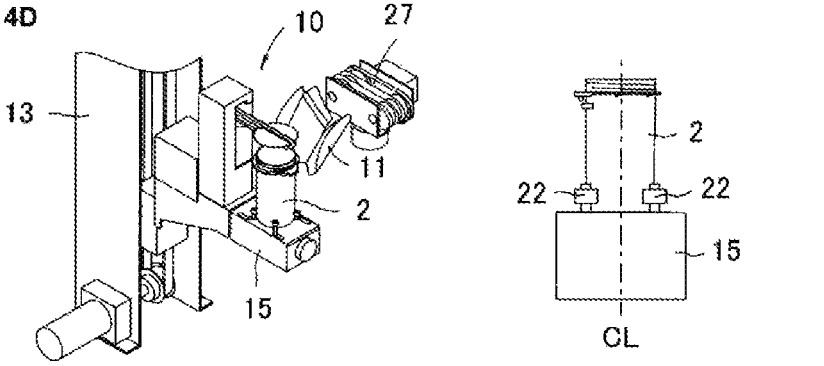
Figure 5C:
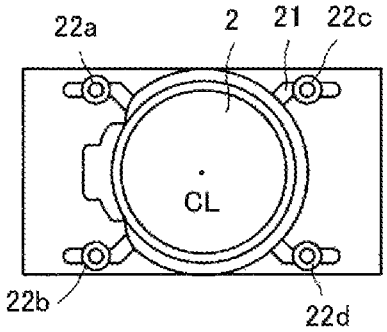
Figure 5D:
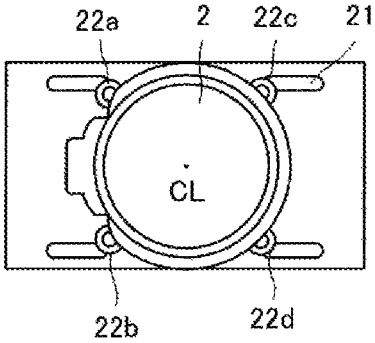

Finally, the vial bottle 2 reaches a position in which the center of the vial bottle 2 coincides with the center CL of the inscribed circle of the measuring pins 22*a*, 22*b*, 22*c*, 22*d* as shown in FIG. 4D and FIG. 5C.

Subsequently, the outer diameter measuring mechanism portion 17 of the main body device 10 is driven to move the measuring pins 22*a*, 22*b*, 22*c*, 22*d* for reducing the diameter of the inscribed circle of the measuring pins 22*a*, 22*b*, 22*c*, 22*d*. Then, each of the measuring pins 22*a*, 22*b*, 22*c*, 22*d* makes contact with the lateral surface of the vial bottle 2. When each of the measuring pins 22*a*, 22*b*, 22*c*, 22*d* makes contact with the lateral surface of the vial bottle 2, the measuring pins 22*a*, 22*b*, 22*c*, 22*d* are stopped by the work of the torque limiter. The inscribed circle of the measuring pins 22*a*, 22*b*, 22*c*, 22*d* is detected from a rotational number detection value of the encoder 175 and the outer diameter of the vial bottle 2 is obtained.

Further, the total height measuring mechanism portion 18 is driven at the same time of the driving of the outer diameter measuring mechanism portion 17.

Figure 6A:
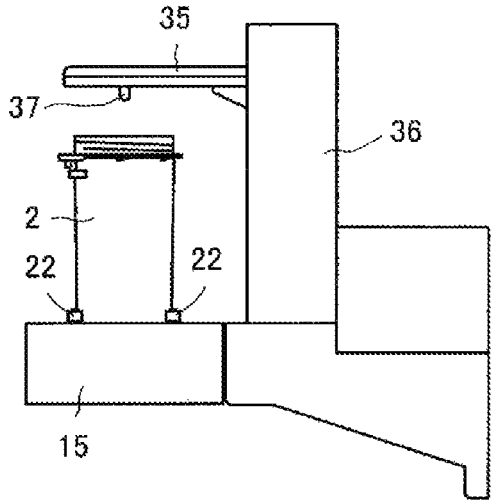
FIGS. 6A to 6C are perspective views showing operations of the total height measuring mechanism portion of the vial bottle checking device shown in FIG. 2.
Figure 6B:
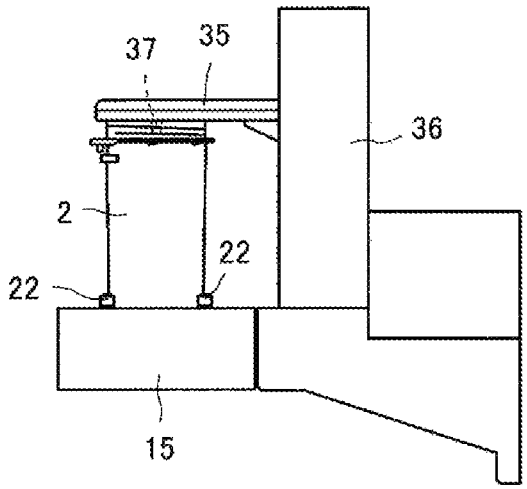

Specifically, the raising and lowering mechanism 36 is driven to lower the height measuring member 35 as shown in FIG. 6A. Then, the lower surface of the height measuring member 35 makes contact with an opening edge of the vial bottle 2 as shown in FIG. 6B. Here, the protruding portion 37 is provided on the height measuring member 35 and this protruding portion 37 gets into a container space from the opening of the vial bottle 2 as shown in FIG. 6B. Thus, the protruding portion 37 does not make contact with the vial bottle 2.

When the height measuring member 35 makes contact with the opening portion of the vial bottle 2, the lowering of the height measuring member 35 is stopped by the work of the torque limiter 176. A height of the height measuring member 35 is detected from a rotational number detection value of the encoder 177 and a total height of the vial bottle 2 is obtained.

Figure 6C:
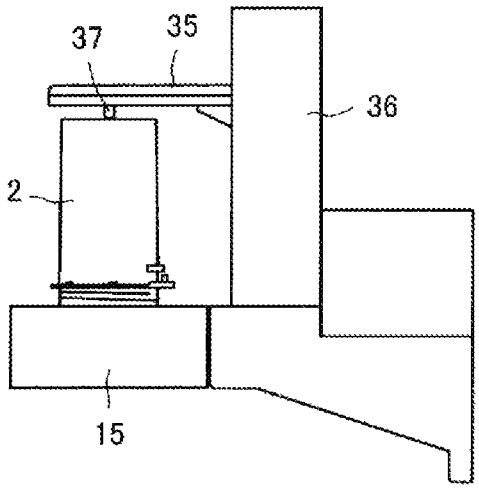

In this regard, if the vertical posture of the vial bottle 2 is reversed, the protruding portion 37 of the height measuring member 35 makes contact with the bottom of the vial bottle 2 and the height measuring member 35 cannot be lowered any more as shown in FIG. 6C.

Thus, in this embodiment, it is possible to check the vertical posture of the vial bottle 2.

As described above, although there are the posture checking sensor and the posture changing means 27 in the transferring path from the container stocking portion 206 to the slope base 11 and the direction of the vial bottle 2 is set so that the opening side is on the upper side in this embodiment, the vertical posture of the vial bottle 2 is re-checked by the vial bottle checking device 1. As described the medicine dispensing device 200 according to this embodiment has a function of double-checking the vertical posture of the vial bottle 2.

As described above, the height, the outer diameter and the vertical posture of the vial bottle 2 are checked by the vial bottle checking device (container checking means) 1 in this embodiment.

If these conditions coincide with data of the vial bottle 2 stored in storage means (not shown), the vial bottle 2 is in a normal state and the vial bottle 2 is transferred to a next process.

Further, if one of the height, the outer diameter and the vertical posture of the vial bottle 2 does not coincide with the data, the apparatus is stopped and a warning is displayed on the monitor screen 221. Further, abnormality is noticed by audio or buzzer sound. A pharmacist takes the vial bottle 2 having the abnormality from the medicine dispensing device 200.

In this embodiment, a door 201 provided on the lateral side of the medicine dispensing device 200 is opened and the pharmacist puts his/her hand into the vial bottle checking device 1 inside the medicine dispensing device 200 to take the vial bottle 2.

Further, in the case where the posture of the vial bottle 2 is reversed upside down, the subsequent operations may be cancelled and the vial bottle 2 may be discharged from the storage shelf 220. And then, indication for noticing this abnormal discharging may be displayed on the monitor screen 221.

(Labeling Device 3)

The labeling device 3 is configured to use a label sheet 50 (see FIG. 8 and FIGS. 9A to 9C) in which a number of pieces of paper for labels 53 are attached to a longitudinal release sheet 48 as is the case with any labeling device of the prior art.

The label sheet 50 is delivered from a paper roll 51 rolled into a roll shape to a printing part 52 through a predetermined label feeding path and a patient name and the like are written on the label sheet 50 by a printing head 54. Then, the label 53 is stripped off by label stripping means 55 and attached to the lateral surface of the vial bottle 2 as shown in FIG. 9B.

Figure 7A:
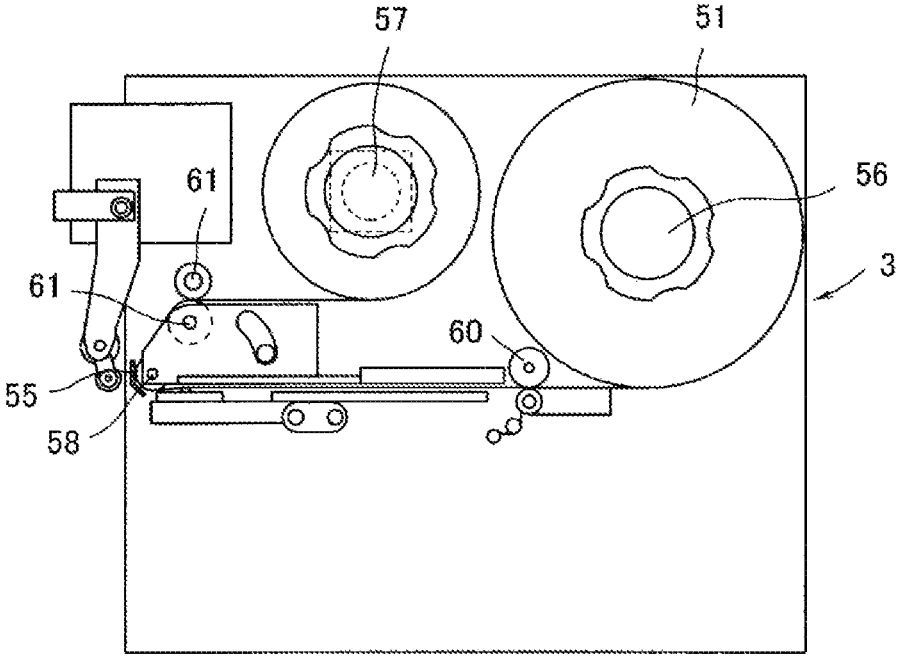
FIGS. 7A and 7B are a planar view of a labeling device built in the medicine dispensing device shown in FIG. 1.
Figure 7B:
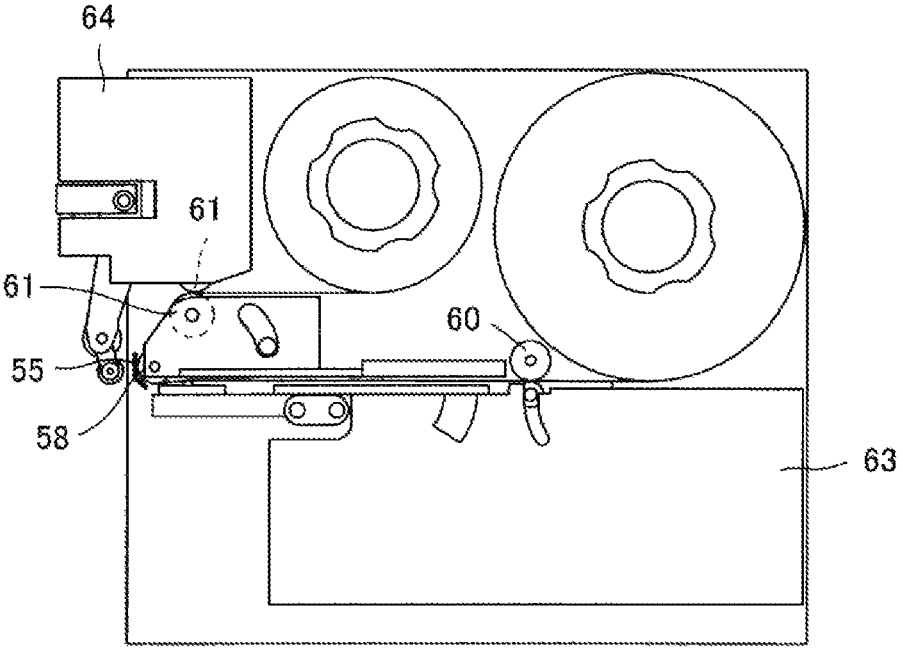
Figure 8:
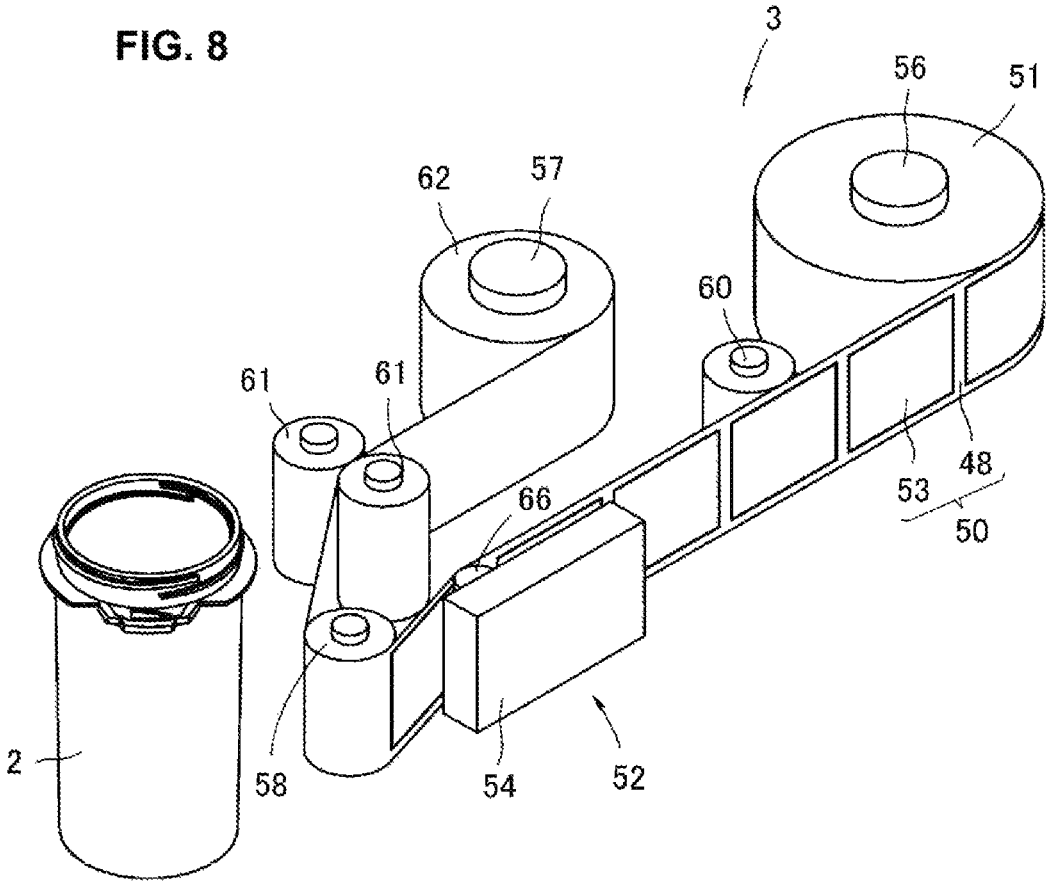
FIG. 8 is a perspective view showing a bridging path of a label sheet of the labeling device shown in FIG. 7.

A layout of the labeling device 3 of this embodiment follows the configuration shown in FIGS. 7, 8 and 9. The labeling device 3 has a delivering side shaft 56, a rolling side shaft 57, a label stripping position roller 58, a direction changing roller 60, a posture correcting roller pair 61 and the printing head 54. Each of the delivering side shaft 56 and the like is provided so as to vertically stand.

Then, the paper roll 51 is attached to the delivering side shaft 56 and a rolling side roll 62 is attached to the rolling side shaft 57.

A motor is engaged to the rolling side shaft 57 through a torque limiter (both of the motor and the torque are not shown). Thus, the rolling side shaft 57 rotates with substantially constant force.

In this regard, in a case other than a case that maintenance work is performed, covers 63, 64 are attached as shown in FIG. 7B. This attempt makes it possible to prevent the label sheet 50 from being rolled into an unnecessary portion at the time of attaching the paper roll 51.

A running path for the label sheet 50 is relatively simple and the number of direction changing portions is small.

The delivering side shaft 56, the direction changing roller 60, the label stripping position roller 58, the posture correcting roller pair 61 and the rolling side shaft 57 are provided in the labeling device 3. Further, the label sheet 50 reaches the label stripping position roller 58 from the paper roll 51 attached to the delivering side shaft 56 through the direction changing roller 60 and rolled on the rolling side roll 62 attached to the rolling side shaft 57 through between the posture correcting roller pair 61 located at an intermediate position.

In this embodiment, there is the printing head 54 at a position from the direction changing roller 60 to the label stripping position roller 58.

Further, a pressing portion 66 is provided at a tip end of the printing head 54. The label sheet 50 delivered to the vicinity of the label stripping roller 58 is pressed toward the side of the label stripping position roller 58 by the pressing portion 66. In this embodiment, the pressing portion 66 is a plate.

Thus, the running path for the label sheet 50 from the direction changing roller 60 to the label stripping position roller 58 is inclined toward the inside with respect to a common tangential line of the direction changing roller 60 and the label stripping position roller 58.

Figure 9A:
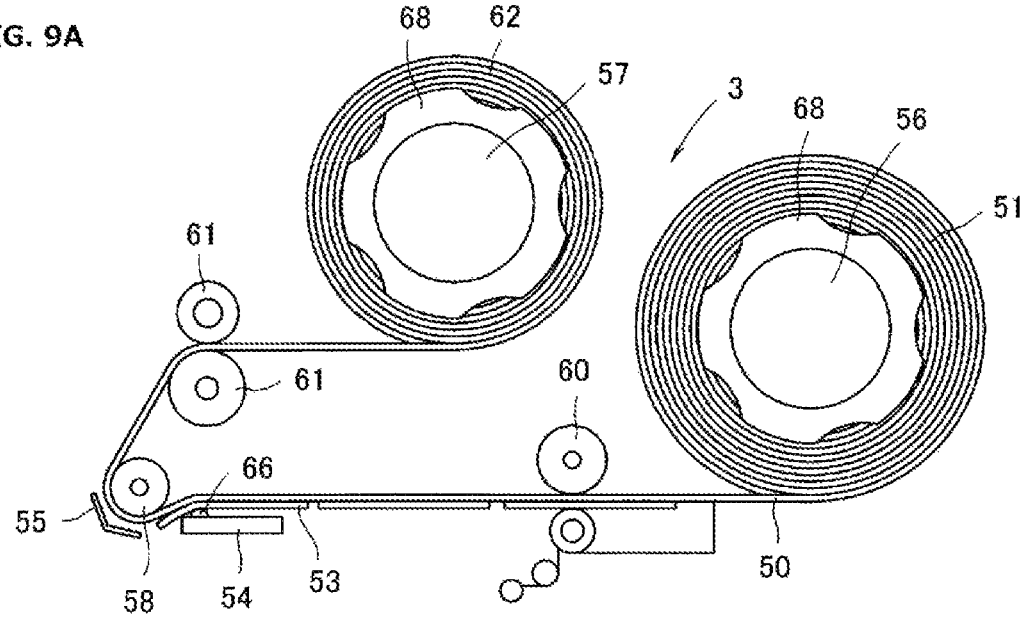
FIGS. 9A and 9B are planar views showing a state that a label is stripped off from the label sheet bridged to the labeling device shown in FIGS. 7A and 7B.
Figure 9B:
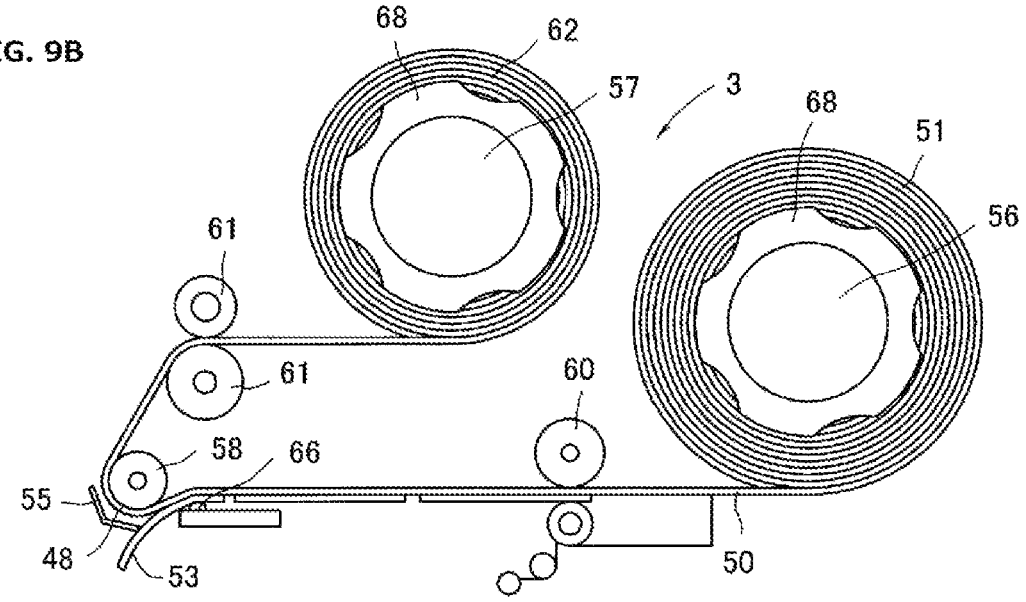
Figure 9C:
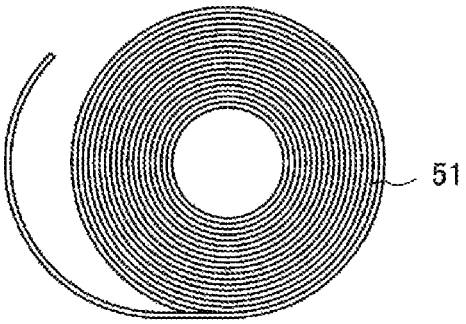
FIG. 9C is a planar view of the label sheet.

Here, since the label sheet 50 is delivered from the paper roll 51, the label roll 50 has curl in the forward direction with respect to the arc of the paper roll 51 as shown in FIG. 9C. Thus, when the label sheet 50 is delivered and placed in a natural state, the label sheet 50 curves in the forward direction with respect to the arc of the paper roll 51 as shown in FIG. 9C.

In this embodiment, the pressing portion 66 is provided at the tip end of the printing head 54 and the label sheet 50 is pressed toward the side of the label stripping position roller 58 by the pressing portion 66 as described above.

Thus, the label sheet 50 is pressed by the pressing portion 66 so that the label sheet 50 is curved in a direction opposite to the curl direction of the paper roll 51.

In this embodiment, although the label 53 is stripped off by the label stripping means 55 which is a spatula plate as shown in FIGS. 9A to 9C, the curl is corrected by pressing the label sheet 50 in the direction opposite to the curl direction immediately before stripping the label 53. Thus, the label 53 stripped off from the release sheet 48 has smaller curl compared with the prior art and is easily attached along the surface of vial bottle 2.

Figure 10A:
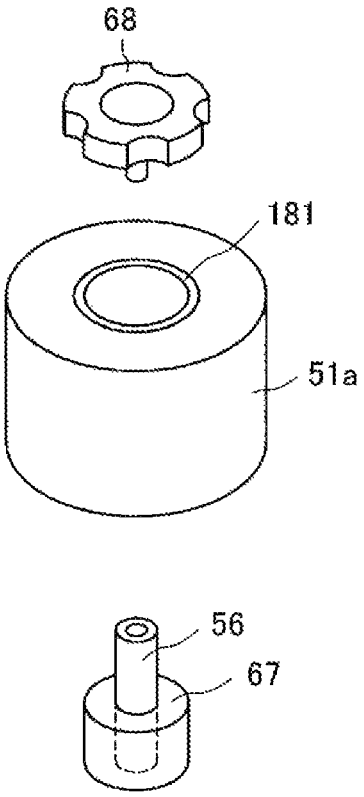
FIGS. 10A and 10B are an exploded perspective view of a roll attachment portion of the labeling device shown in FIGS. 7A and 7B.
Figure 10B:
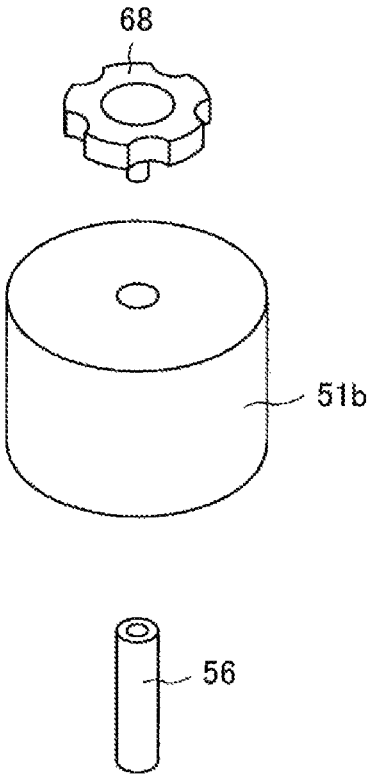

By the way, a paper roll 51*a* having a core 181 as shown in FIGS. 10A and 10B and a paper roll 51*b* having no core are commercially available as the paper roll 51 obtained by rolling the label sheet 50. Further, there are a type having the core with a large core diameter and another type having the core with a small core diameter.

The labeling device 3 employed in this embodiment can use all of the paper roll 51*a* having the core with the large core diameter, the paper roll having the core with the small core diameter and the paper roll 51*b* having no core.

In the labeling device 3 of this embodiment, a core 67 can be attached to the delivering side shaft 56 and the rolling side shaft 57 as shown in FIG. 10A. The core 67 rotates integrally with the delivering side shaft 56 or the like.

By attaching the core 67 to the delivering side shaft 56 or the like as shown in FIG. 10A, it is possible to substantially increase a shaft diameter of the delivering side shaft 56 or the like and this makes it possible to attach the paper roll 51*a* with the large core diameter to the delivering side shaft 56 or the like.

When the core 67 is removed as shown in FIG. 10B, the paper roll 51*b* having no core can be attached to the delivering side shaft 56 or the like.

In each case, a retaining cap 68 is attached to the delivering side shaft 56 and the rolling side shaft 57 for preventing the paper roll 51 or the like from dropping out.

Although the above-mentioned labeling device 3 has the delivering side shaft 56 and the rolling side shaft 57 and employs the configuration in which the release sheet 48 is rolled on the rolling side shaft 57, the recovering of the release sheet 48 is not limited to the method of rolling it on the recovering roll. For example, the lease sheet may be put between a roll pair constituted of two rolls, the rolls of the roll pair may be rotated to pull the release sheet, and a recovering container may be provided at the downstream side of the above-mentioned roll pair to put the release sheet in the recovering container.

(The Sealing Device 5)

Figure 11:
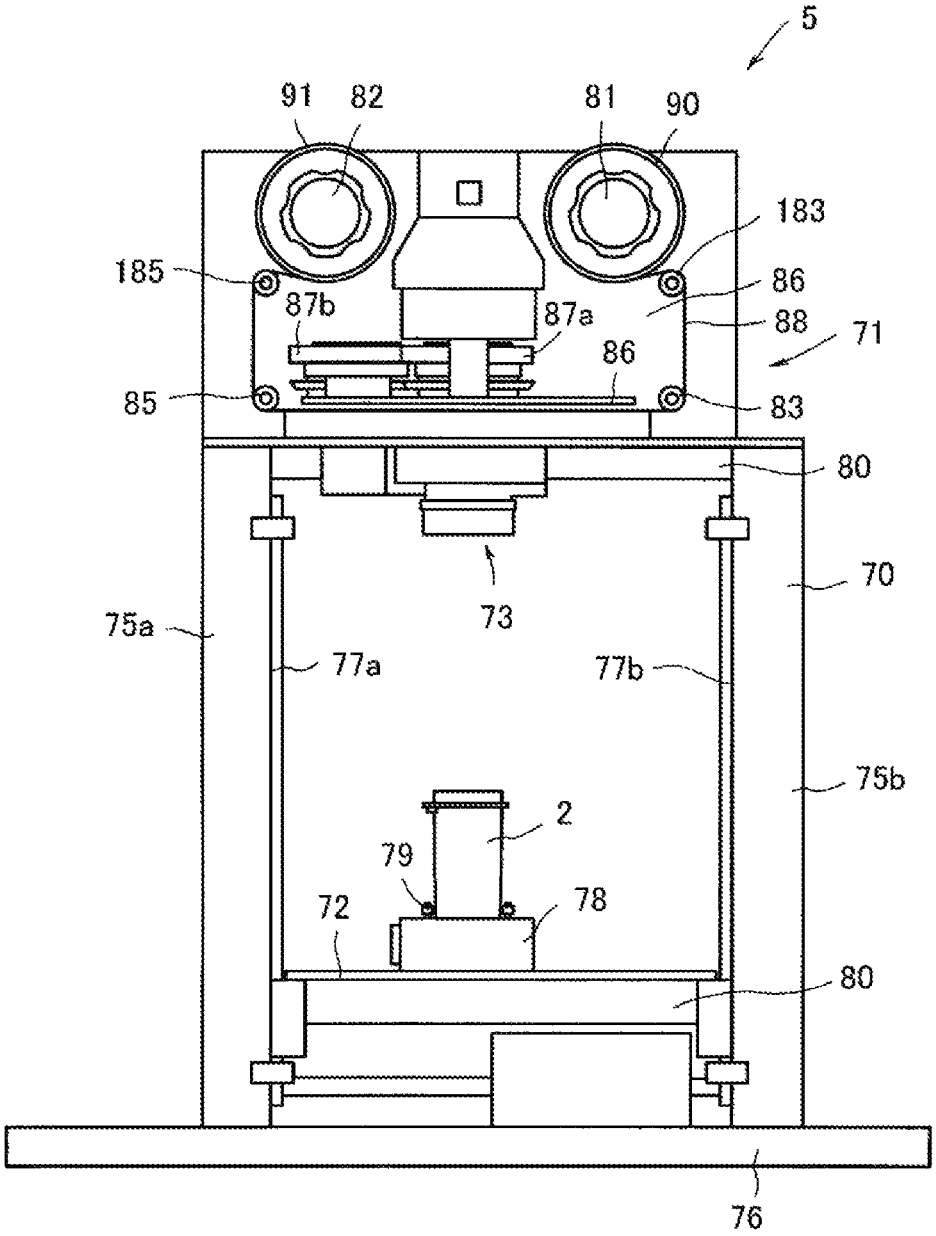
FIG. 11 is a front view of a sealing device built in the medicine dispensing device shown in FIG. 1.

The sealing device 5 includes a portal frame 70, a sheet attachment portion 71, a raising and lowering base 72 and a photographing device 73 as shown in FIG. 11.

The portal frame 70 is obtained by providing a side wall members 75*a*, 75*b* so as to parallel stand on a base member 76 and bridging a partition plate 80 between the side wall members 75*a*, 75*b*.

Guide rails 77*a*, 77*b* are respectively attached to the side wall members 75*a*, 75*b* of the portal frame 70.

Both ends of the raising and lowering base 72 are respectively engaged with the guide rails 77*a*, 77*b* of the portal frame 70. A motor (not shown) is mounted on the raising and lowering base 72 and the raising and lowering base 72 is raised and lowered between the side wall members 75*a*, 75*b*.

A vial bottle support base 78 is provided on the raising and lowering base 72. The vial bottle support base 78 has the same configuration as the installation base 15 of the vial bottle checking device 1 and has holding pins 79. BY rotating a motor (not shown), a diameter of an inscribed circle of the holding pins 79 is changed.

The sheet attachment portion 71 is arranged on the upper side of the partition plate 80.

The sheet attachment portion 71 has a delivering side shaft 81, a rolling side shaft 82, direction changing rollers 83, 85, supportive rollers 183, 185 and a turntable (a movable table) 86. A plurality of heat-sealing heads 87*a*, 87*b* are attached to the turntable 86. In this embodiment, the heat-sealing head 87*a* for 30 mm opening vial bottles and the heat-sealing head 87*b* for 40 mm opening vial bottles are attached.

The delivering side shaft 81, the rolling side shaft 82, the direction changing rollers 83, 85 and the supportive rollers 183, 185 are arranged so that all of their axial lines are directed to the horizontal direction.

The delivering side shaft 81, the rolling side shaft 82 and the supportive rollers 183, 185 are arranged on the upper side and the direction changing rollers 83, 85 are arranged on the lower side. When positions of the supportive rollers 183, 185 and the direction changing rollers 83, 85 are viewed from the front side, these members are arranged so as to form each corner of a rectangle as shown in FIG. 11.

The turntable 86 is located between the direction changing rollers 83, 85.

Further, a resin roll 90 of a resin sheet 88 is attached to the delivering side shaft 81. Further, a rolling side roll 91 is attached to the rolling side shaft 82.

A resin sheet 88 is obtained by laminating an adhering layer on one surface of a resin film, a non-woven cloth or the like. The adhering layer is melted when the adhering layer is heated and provides adhering force.

The resin sheet 88 is configured to be attached to the opening portion of the vial bottle 2. It is preferable that the resin sheet 88 is made of a material having transparency so that the inside of the vial bottle 2 can be seen in a state that the resin sheet 88 is attached to the vial bottle 2.

Figure 12:
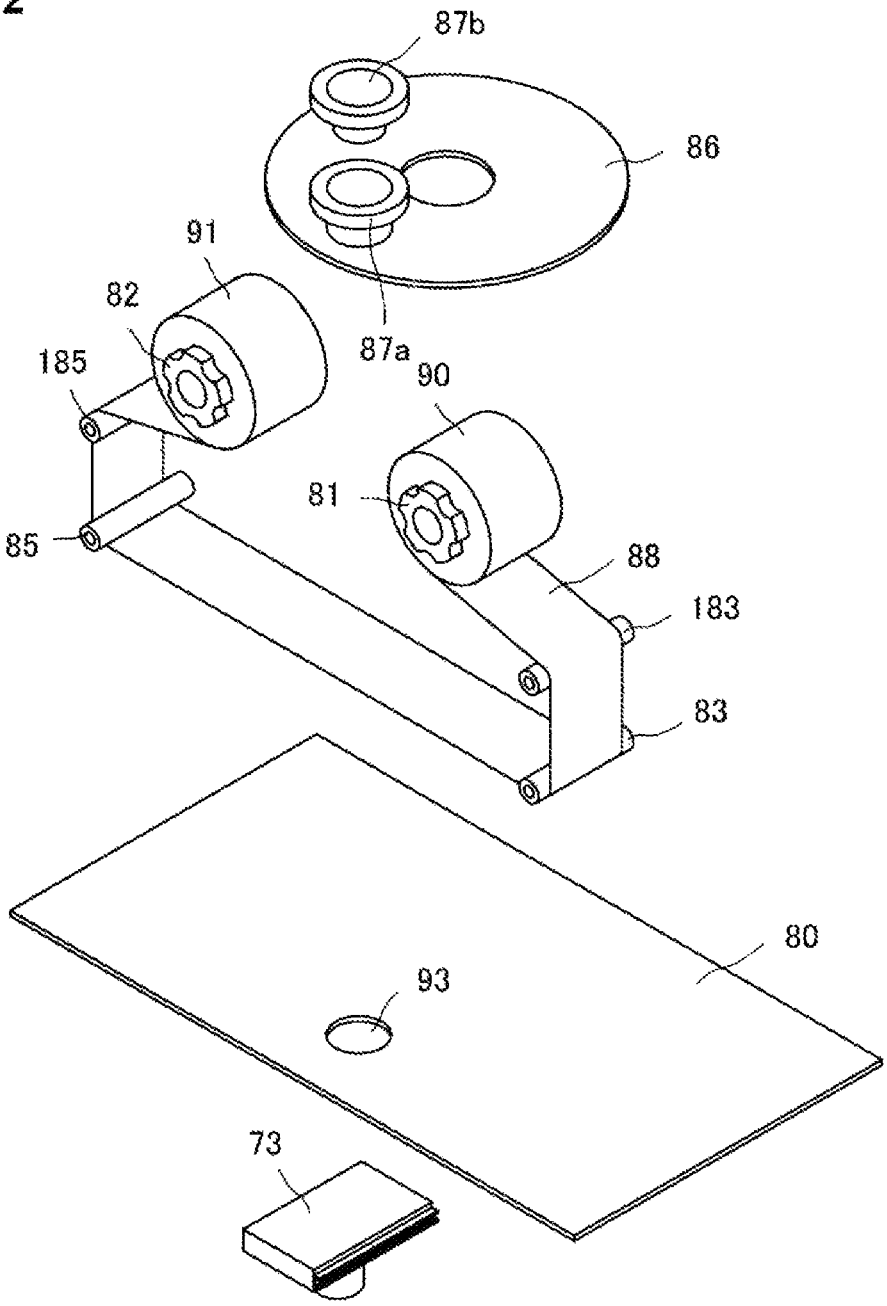
FIG. 12 is an exploded perspective view of a main part of the sealing device shown in FIG. 11.

A bridging path of the resin sheet 88 follows the configuration shown in FIG. 12 and the resin sheet 88 is rolled on the rolling side roll 91 attached to the rolling side shaft 82 from the resin roll 90 attached to the delivering side shaft 81 through the supportive roller 183, the direction changing rollers 83, 85 and the supportive roller 185.

The resin sheet 88 runs between the direction changing rollers 83, 85 takes a parallel posture in parallel with an upper surface of the partition plate 80. Further, the resin sheet 88 passes through a space between the partition plate 80 and the turntable 86.

A circular opening 93 is formed in the partition plate 80 and the resin sheet 88 covers this opening.

The photographing device 73 is a digital camera. The photographing device 73 is a container inside photographing camera for photographing the inside of the vial bottle 2 in the state that the vial bottle 2 is filled with the medicines. The photographing device 73 has a focus correcting function of correcting focus thereof in addition to a normal photographing function.

The focus correcting function is a function of correcting the focus based on the amount of the medicines filled into the vial bottle 2.

The medicine dispensing device of this embodiment is configured to count the number of the tablets or the like and automatically fill the vial bottle 2 with the tablets or the like. In this embodiment, a size of the tablet and the information of the vial bottle are stored in the storage device (not shown).

Further, in this embodiment, a filling condition of the tablets or the like in the vial bottle 2 is expected from the number of the prescribed tablets, the size of the tablet, a cross-sectional area of the vial bottle and the like and a position of an upper end of the tablets is computed. Alternatively, a relationship between the amount of the tablets and the position of the upper end of the tablets are databased and stored.

For example, information that the upper end of the tablets is located at a 60 mm position from the bottom of the vial bottle 2 in a case where 200 specific tablets are filled in the vial bottle 2 whose opening diameter is 30 mm is stored.

Further, the photographing device 73 performs the focus correcting so as to focus on the tablet at the highest portion computed by the computing or the like or the vicinity of the tablet at the highest portion.

Further, the photographing device 73 includes a light (not shown). The photographing device 73 is attached to an arm (not shown) which can linearly move and moves inside and outside of the portal frame 70.

Next, description will be given to operations of the sealing device 5.

In an idling posture, the raising and lowering base 72 has been lowered to the lowest portion as shown in FIG. 11. Further, the photographing device 73 protrudes to a lower portion of the partition plate 80 within a frame of the portal frame 70.

Suitable one of the heat-sealing heads 87*a*, 87*b* is selected depending on the size of the vial bottle 2 next transferred and the turntable 86 rotates. As a result, the suitable one of the heat-sealing heads 87*a*, 87*b* stands by above the opening 93 of the partition plate 80.

As described above, the vial bottle 2 filled with the tablets is transferred to the sealing part. The vial bottle 2 is provided on the vial bottle support base 78 of the raising and lowering base 72 by a robot hand or the like.

The vial bottle support base 78 drives the holding pins 79 to reduce the diameter of the inscribed circle of the holding pins 79 for holding the lower portion of the vial bottle 2.

In this regard, the size of the vial bottle 2 may be checked at this time.

Figure 13A:
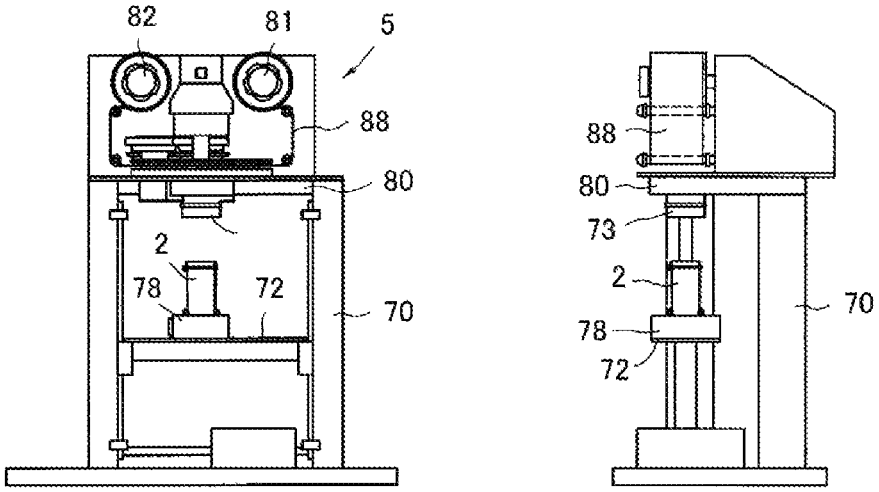
FIGS. 13A to 13C are schematic views for explaining operations of the sealing device shown in FIG. 11.

Then, the raising and lowering base 72 is raised to raise the vial bottle 2 to a position near the photographing device 73 as shown in FIG. 13A.

Subsequently, the light for photographing is turned on and the inside of the vial bottle 2 is photographed by the photographing device 73. A photographed image is displayed on the external monitor screen 221 and stored in the storage means. The photographed image data, the patient information and the prescription information are stored in the storage means as a pair.

Figure 13B:
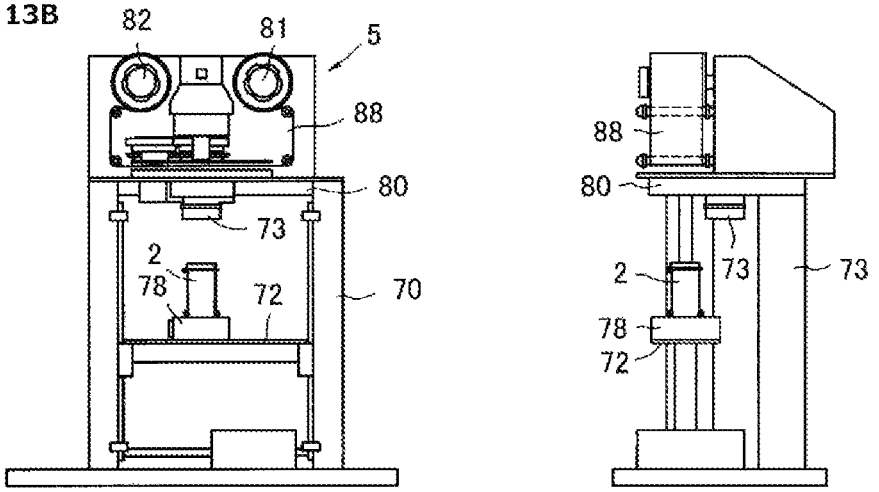

When the photographing is completed, the photographing device 73 moves away from the portal frame 70 as shown in FIG. 13B.

Figure 13C:
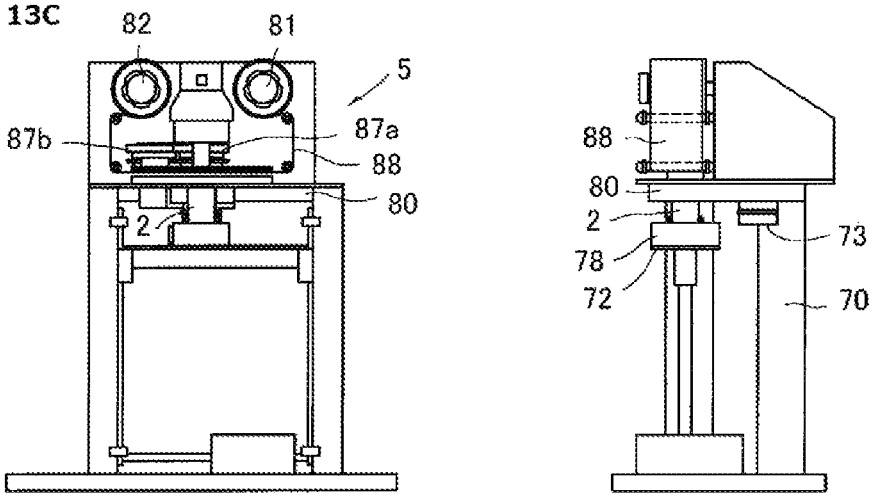

Then, the raising and lowering base 72 is further raised to put the opening portion of the vial bottle 2 into the opening 93 of the partition plate 80 as shown in FIG. 13C.

Since the upper portion of the opening 93 of the partition plate 80 is covered by the resin sheet 88, the opening edge of the vial bottle 2 presses the resin sheet 88.

Then, a portion of the resin sheet 88 making contact with the opening marginal portion of the vial bottle 2 is heated by one of the heat-sealing heads 87*a*, 87*b* and the resin sheet 88 adheres to the opening marginal portion of the vial bottle 2.

After that, the resin sheet 88 is punched along the opening marginal portion of the vial bottle 2.

Then, the delivering side shaft 81 and the rolling side shaft 82 are rotated to move a punched portion of the resin sheet 88 toward the delivering side shaft 81 and cover the opening 93 of the partition plate 80 with a new surface of the resin sheet.

On the other hand, the raising and lowering base 72 is lowered to extract the vial bottle 2 from the opening 93 of the partition plate 80. Then, the vial bottle 2 is discharged to the storage shelf 220 of the medicine dispensing device 200 by a discharging mechanism (not shown).

Although the resin sheet 88 is employed as a sheet for sealing the opening of the vial bottle 2 in this embodiment, a sheet which can adhere due to heat may be used and a main material for the sheet is not limited to a resin. For example, the sheet may be a sheet whose main material is an aluminum foil and an adhering layer is laminated on one surface of the aluminum foil.

It is preferable that the resin sheet 88 makes it possible to see the inside of the vial bottle 2 as described above and it is recommended that the resin sheet 88 is transparent. However, the present invention does not limit the material of the resin sheet 88 and a nontransparent sheet such as the above-mentioned aluminum foil may be used.

Although the above-mentioned sealing device 5 employs the configuration which has the delivering side shaft 81 and the rolling side shaft 82 and in which the resin sheet 88 remaining after the punching is rolled on the rolling side shaft 82, the recovering of the resin sheet 88 is not limited to the method of rolling the resin sheet 88 on the rolling side shaft 82. For example, the resin sheet 88 may be put between a roll pair constituted of two rolls, the rolls of the roll pair may be rotated to pull the release sheet and a recovering container may be provided on the downstream side of the above-mentioned roll pair to recover the resin sheet 88 in the recovering container.

Although the above-mentioned sealing device 5 heats the portion of the resin sheet 88 making contact with the vial bottle 2 with only heat of one of the heat-sealing heads 87*a*, 87*b* to seal the opening marginal portion of the vial bottle 2 with the resin sheet 88, other preheating means may be used together with the heat-sealing heads 87*a*, 87*b*. For example, the resin sheet 88 may be heated by a preheating heater or the like before the resin sheet 88 reaches the opening edge of the vial bottle 2.

(Empty Container Transferring Device 6)

The empty container transferring device 6 is constituted of a container storing box 140, feeding means 141 and a lifting device 142.

Further, transferring means 143 is arranged in the vicinity of the empty container transferring device 6 as an auxiliary device.

The container storing box 140 is a substantially rectangular parallelepiped box whose four sides are surrounded by side walls 138*a*, 138*b*, 138*c*, 138*d* and upper surface is opened. Namely, the container storing box 140 has the longer-side side walls 138*a*, 138*c* and the shorter-side side walls 138*b*, 138*d* and its upper surface is opened.

The feeding means 141 is a belt conveyer whose width is broad and total length is short. The feeding means 141 has a driving side pulley 144, a following side pulley 145 and a conveyer belt 146. The driving side pulley 144 is rotated by a motor (not shown).

The conveyer belt 146 is an endless body made of a resin or a rubber. Rails 149 are provided on a surface of the conveyer belt 146 so as to be apart from each other at regular intervals. A distance between the adjacent rails 149 is much longer than the total length of the vial bottle 2.

The conveyer belt 146 bridges between the driving side pulley 144 and the following side pulley 145 described above. Further, when the driving side pulley 144 is rotated, the conveyer belt 146 runs. In this embodiment, it is possible to run the conveyer belt 146 in a reverse direction opposite to a normal direction.

The lifting device 142 is a belt conveyer whose width and total length are short. The lifting device 142 is arranged with an inclined posture. Thus, the lifting device 142 is an inclined conveyer.

The lifting device 142 has a frame 156, a driving side pulley 147, a following side pulley 148 and a conveyer belt 150. The driving side pulley 147 is rotated by a motor (not shown).

The conveyer belt 150 is an endless body made of a resin or a rubber. Rails 151 are provided on a surface of the conveyer belt 150 so as to be apart from each other at regular intervals. A distance between the adjacent rails 151 is substantially identical to the total length of the vial bottle 2. The distance between the adjacent rails 151 provided at the lifting device 142 is narrower than the distance between the adjacent rails 149 provided at the feeding means 141.

The frame 156 is constituted of a plate body having a substantially triangular shape. The driving side pulley 147 is provided on one side of an inclined side 157 of the frame 156 and the following pulley 148 is provided on the other side of the inclined side 157 of the frame 156.

Further, almost of the upper surface of the conveyer belt 150 is exposed from the inclined side 157 of the frame 156.

In this regard, guide walls 158*a*, 158*b* are respectively provided at points on the inclined side 157 of the frame 156 arranged inside the container storing box 140. The guide wall 158*a* is provided on an extension line of the side wall of the frame 156 and constitutes a plane substantially same as the frame 156. When the guide wall 158*a* is view from the front side, the guide wall 158*a* has a trapezoidal shape and both side portions thereof are inclined. When the guide wall 158*b* is viewed from the front side, the guide wall 158*b* has a triangular shape and both side portions thereof are inclined.

The guide wall 158*b* is configured to correct the posture of the vial bottle 2 and prevent the vial bottle 2 from falling down from the lifting device 142. Further, the guide wall 158*b* further has a function of returning the vial bottle 2 whose posture cannot be corrected to the side of the feeding means 141 of the container storing box 140.

The lifting device 142 is configured to carry the vial bottle 2. A lower end of the lifting device 142 serves as a loading port portion 153 and an upper end of the lifting device 142 serves as an unloading port portion 153 in the inclined posture.

A guide member 165 is provided on the side of the side wall of the container storing box 140 in the vicinity of the unloading port portion 153. The guide member 165 is configured to correct the posture of the vial bottle 2.

The above-mentioned feeding means 141 is arranged on a bottom portion of the container storing box 140 and the conveyer belt 146 of the feeding means 141 substantially constitutes a bottom surface of the container storing box 140.

Although the feeding means 141 can run the conveyer belt 146 in the reverse direction opposite to the normal direction, the conveyer belt 146 runs from the shorter-side side wall 138*b* on the right side in the figure to the shorter-side side wall 138*d* on the left side in the figure in a normal operation.

Hereinafter, for the purpose of facilitating understanding of the present invention, the direction from the shorter-side side wall 138*b* on the right side in the figure to the shorter-side side wall 138*d* on the left side in the figure is sometimes referred to as a running direction of the feeding means. Further, the side of the shorter-side side wall 138*d* on the left side in the figure is sometimes referred to as a travelling direction end of the feeding means.

The above-mentioned lifting device 142 is arranged on the longer-side side wall 138*a* on the one side in the container storing box 140.

The lifting device 142 is attached with the inclined posture as shown in FIGS. 14A to 14D and the loading port portion 152 is located on the bottom portion of the container storing box 140 and in the vicinity of the shorter-side side wall 138*d* of the container storing box 140 (the end of the travelling direction of the feeding means). The unloading port portion 153 of the lifting device 142 is located on the shorter-side side wall 138*b* on the other side of the container storing box 140 and at the upper end of the container storing box 140 in the height direction.

An introducing member 215 is provided at the travelling direction end of the feeding means of the container storing box 140. The introducing member 215 is an inclined plate for narrowing the width of the feeding means 141 in the vicinity of the end of the travelling direction to move the running path to the side of the lifting device 142.

Posture of the introducing member 215 is inclined to both of the horizontal direction and the height direction.

Figure 14A:
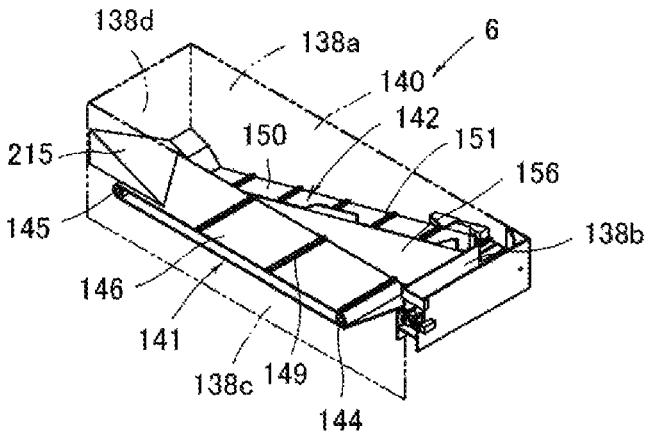
FIG. 14A is a perspective view of a container stocking portion built in the medicine dispensing device shown in FIG. 1.
Figure 14B:
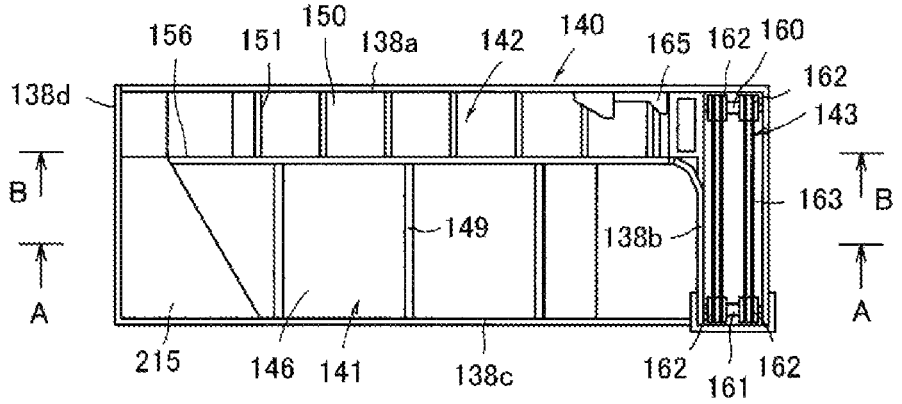
FIG. 14B is a planar view of the container stocking portion.
Figure 14C:
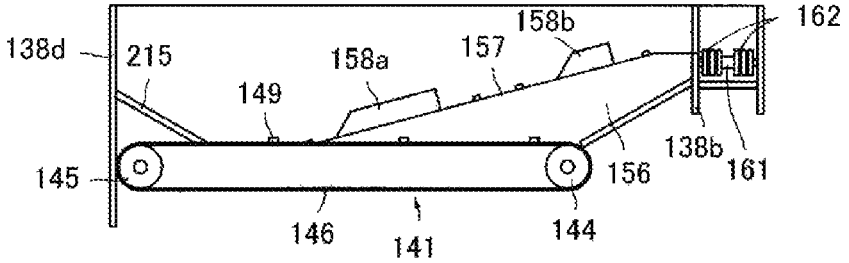
FIG. 14C is an A-A line cross-sectional view of FIG. 14B.
Figure 14D:
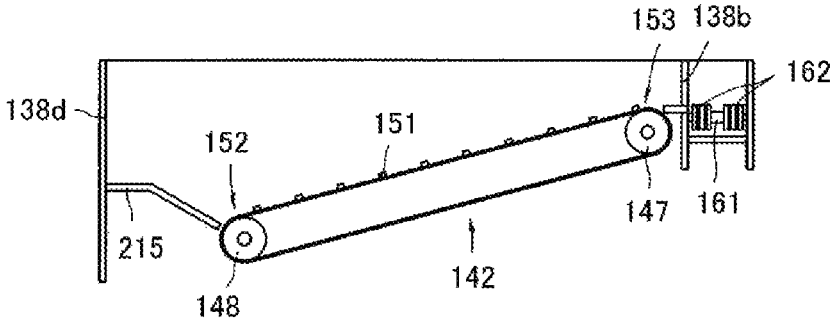
FIG. 14D is a B-B line cross-sectional view of FIG. 14B.
Figure 15:
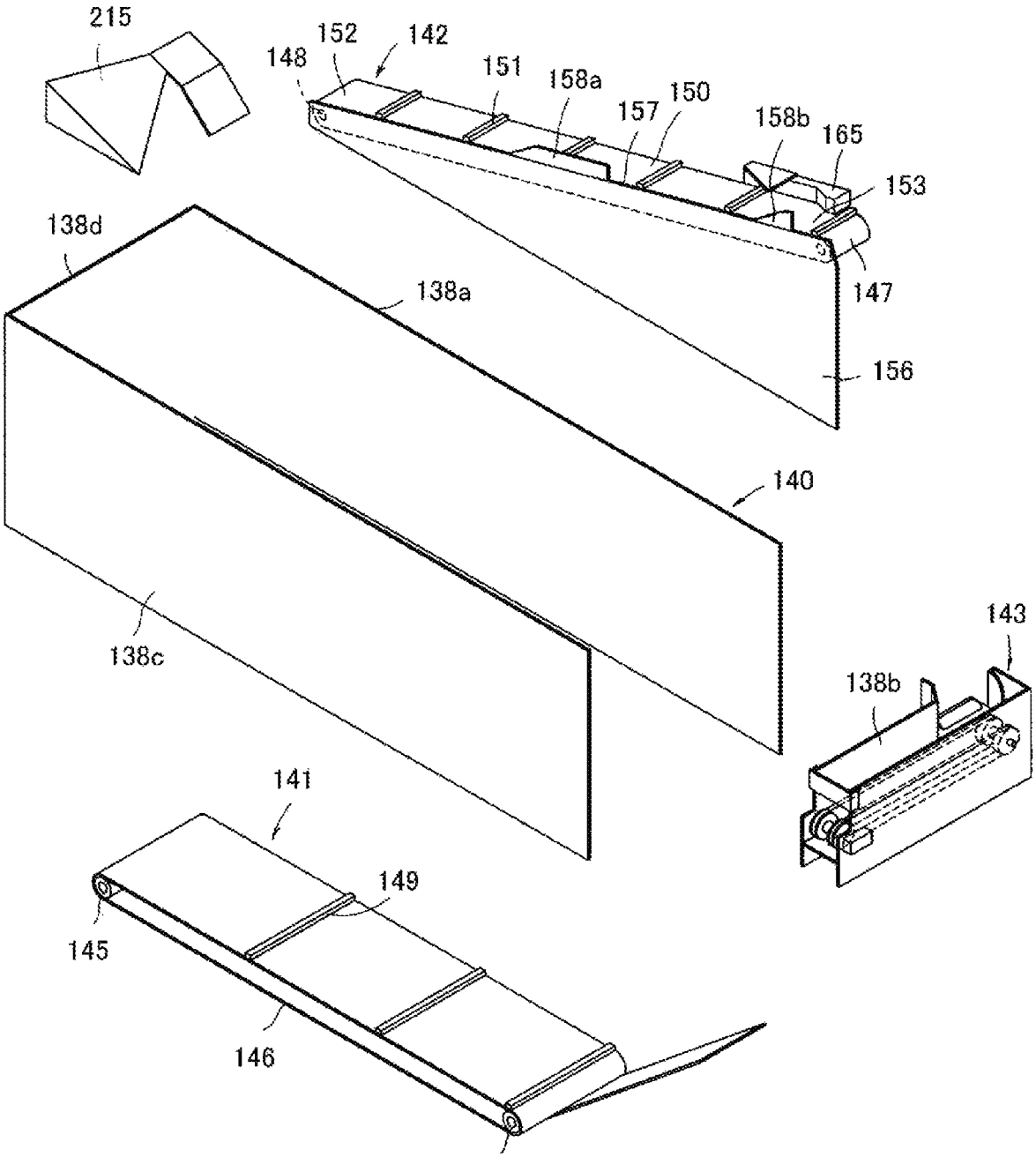
FIG. 15 is an exploded perspective view of the container stocking portion shown in FIG. 14.

When the introducing member 215 is viewed from the upper side of the container storing box 140, the introducing member 215 diagonally traverses over the bottom surface of the container storing box 140 (this is substantially the conveyer belt 146 of the feeding means 141) as shown in FIG. 14B.

The running path constituted of the feeding means 141 is a space surrounded by the side wall of the frame 156 of the lifting device 142 and the longer-side side wall 138*c* of the container storing box 140 the width of the running path is broad until the running path reaches from the shorter-side side wall 138*b* on the right side in the figure to the introducing member 215.

In contrast, on the downstream side than the introducing member 215, the space between the introducing member 215 and the side wall of the frame 156 of the lifting device 142 becomes the running path and the running path gradually moves to the side of the loading port portion 152 of the lifting device 142.

Further, posture of the introducing member 215 is also inclined to the height direction and thus forms a slope.

Next, description will be given to the transferring means 143. The transferring means 143 has a driving side shaft 160 and a following side shaft 161 and four pulleys 162 are attached to the driving side shaft 160 and the following side shaft 161. The four pulleys 162 are categorized into two groups constituted of the two pulleys 162 and the two groups of the two pulleys 162 are respectively attached to the driving side shaft 160 and the following side shaft 161. Setting intervals of the pulleys 162 belonging to each group are short and a space between the groups is broader than the setting intervals.

Further, belts 163 such as round belts whose width is small are bridged between the pulleys of the driving side shaft 160 and the corresponding pulleys of the following side shaft 161.

Next, description will be given to operations of the empty container transferring device 6.

Figure 16A:
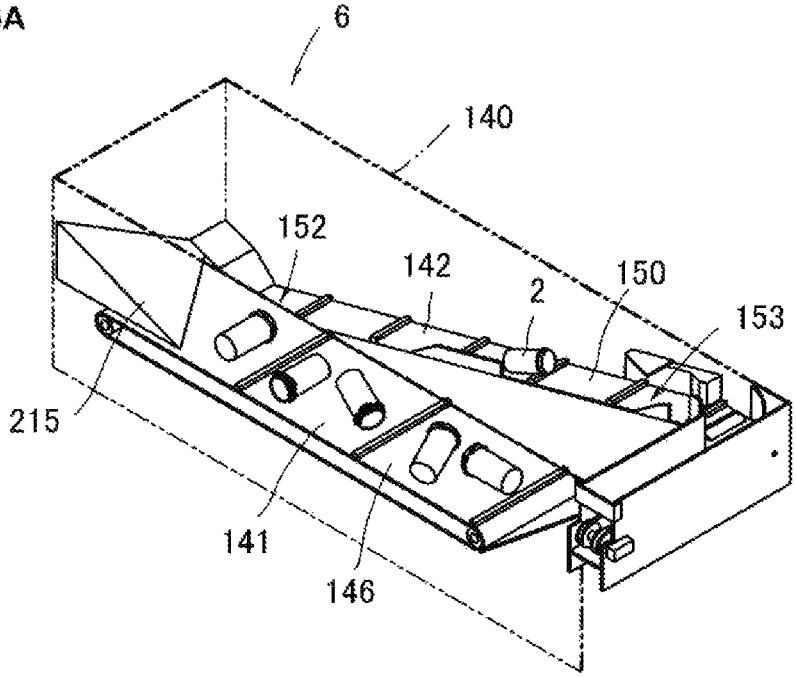
FIG. 16A is a schematic perspective view showing a configuration in the medicine stocking portion and FIG. 16B is a perspective view of the vial bottle.

In this embodiment, a number of vial bottles 2 are put into the empty storing container 140 as shown in FIG. 16A.

Figure 16B:
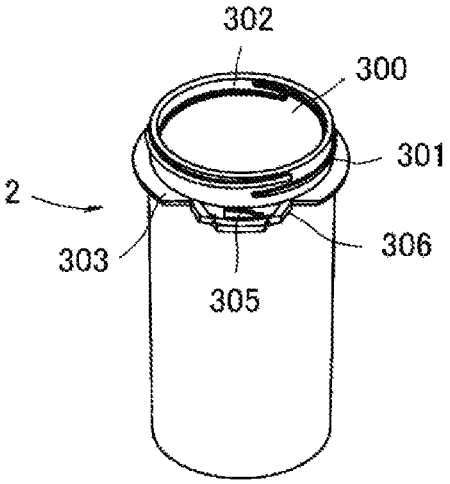

Here, the shape of each of the vial bottles 2 is shown in FIG. 16B. Each of the vial bottles 2 is a container having a substantially cylindrical shape whose bottom portion and peripheral portion are closed and upper surface is opened as shown in FIG. 16B.

Screws 301, 302 are provided on both of an outer peripheral surface and an inner peripheral surface of the opening portion 300 of the vial bottle 2. Further, a flange portion 303 is provided at a vicinity portion of the opening portion 300 on the outer peripheral surface of the vial bottle 2. A part of the flange portion 303 is cut out and an engaging claw 305 is formed at this cut-out portion. The engaging claw 305 is connected to a holding frame 306 continuing to the flange portion 303.

In the empty container transferring device 6, the conveyer belt 146 of the feeding means 141 is run in the normal direction in a state that a number of vial bottles 2 are put in the container storing box 140. Namely, the conveyer belt 146 is run in the normal direction toward the introducing member 215.

Further, the lifting device 142 is driven to run the conveyer belt 150 from the loading port portion 152 on the bottom side of the empty container transferring device 6 to the unloaded port portion 153 on the diagonally upward direction.

Figure 17A:
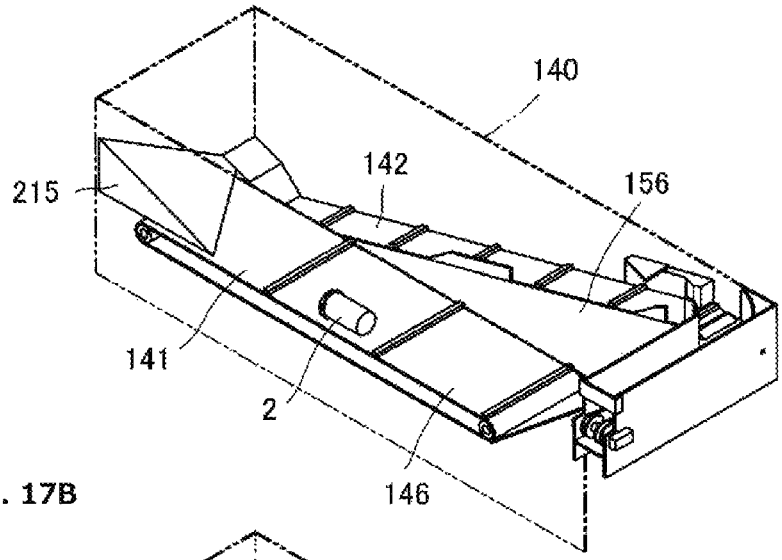
FIGS. 17A to 17C are schematic perspective views showing the configuration in the container stocking portion and perspective views for explaining movement of one vial bottle in turn with focusing on the one vial bottle.

With focusing on one of the vial bottles 2 put in the container storing box 140, the vial bottle 2 is located at an about middle portion of the container storing box 104 as shown in FIG. 17A, for example. The width of the running path of the feeding means 141 at this portion is defined by the side wall of the frame 156 of the lifting device 142 and the longer-side side wall 138*c* of the container storing box 140 and thus the width is broad.

Figure 17B:
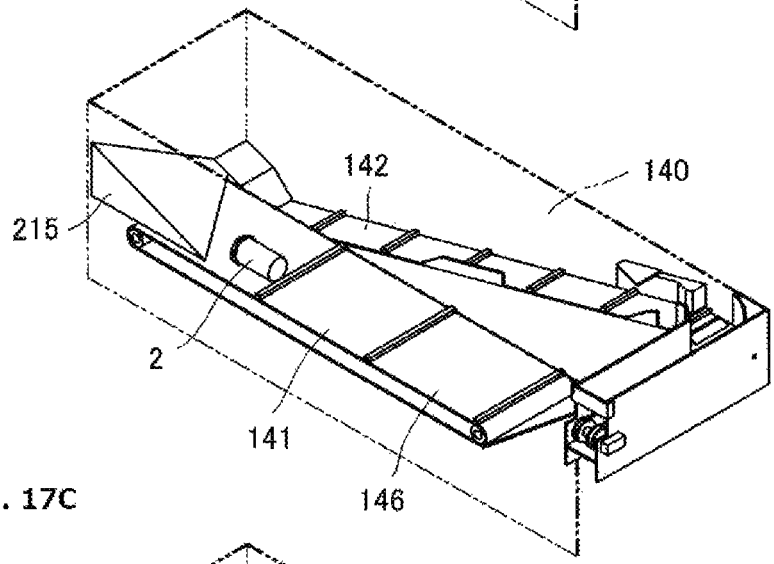

The vial bottle 2 is transferred to the downstream side by the conveyer belt 146 of the feeding means 141 and its head portion hits the introducing member 215 as shown in FIG. 17B.

As a result, the head portion of the vial bottle 2 stops moving in the running direction of the feeding means 141.

Figure 17C:
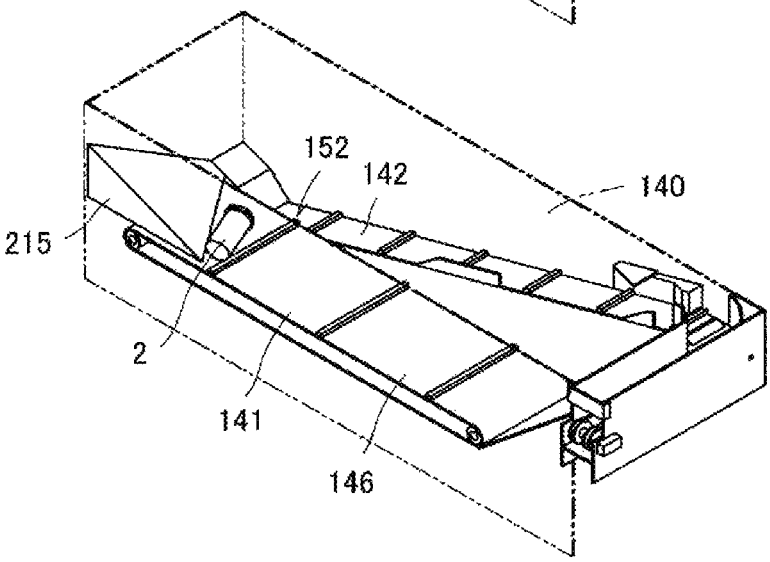

On the other hand, the conveyer belt 146 of the feeding means 141 keeps running and other portions of the vial bottle 2 are kept to be biased by the conveyer belt 146 toward the introducing member 215. Thus, the posture of the vial bottle 2 is changed to posture along the introducing member 215 as shown in FIG. 17C.

In this state, the vial bottle 2 is further biased to the downstream side by the conveyer belt 146 of the feeding means 141. On the other hand, since the introducing member 215 is inclined to the diagonal direction in the planar view thereof as shown in FIG. 14B, component force is generated in the horizontal direction with respect to the travelling direction of the conveyer belt 146 and thus the vial bottle 2 moves to the downstream side along the introducing member 215.

Here, since the introducing member 215 is inclined to the diagonal direction in the planar view thereof as shown in FIG. 14B as described above, the running path in the vicinity of the end of the travelling direction of the feeding means 141 is gradually narrowed and moves to the side of the loading port portion 152 of the lifting device 142.

Figure 18A:
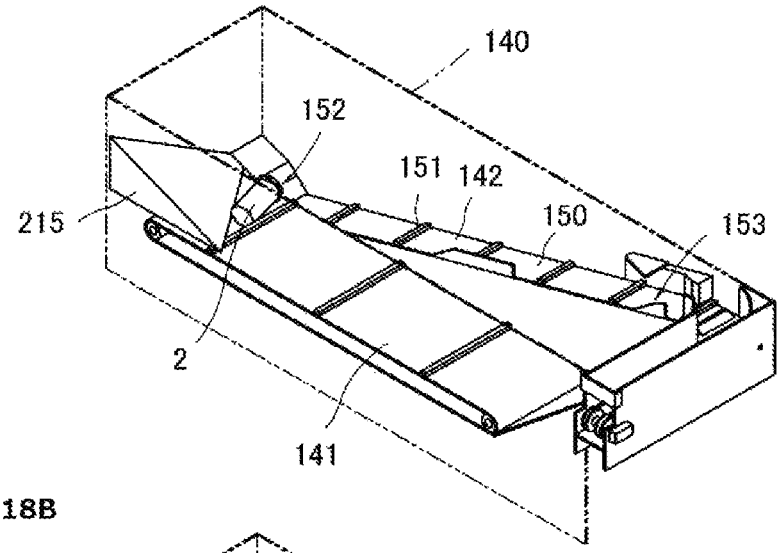
FIGS. 18A and 18B are perspective views for explaining the movement of the vial bottle in turn following to FIGS. 17A and 17B.

Thus, the vial bottle 2 enters into the loading port portion 152 of the lifting device 142 as shown in FIG. 18A.

The conveyer belt 150 of the lifting device 142 runs from the loading port portion 152 to the unloading port portion 153 on the diagonally upward side as described above.

Here, the vial bottle 2 has the flange portion 303 at the vicinity portion of the opening portion 300. On the other hand, the conveyer belt 150 of the lifting device 142 has the rails 151. Thus, the flange portion 303, the bottom portion, the opening edge and the like of the vial bottle 2 are hooked and engaged with the rails 151 of the conveyer belt 150. As a result, the posture of the vial bottle 2 is changed so that the axial direction thereof follows the running direction of the conveyer belt 150.

Figure 18B:
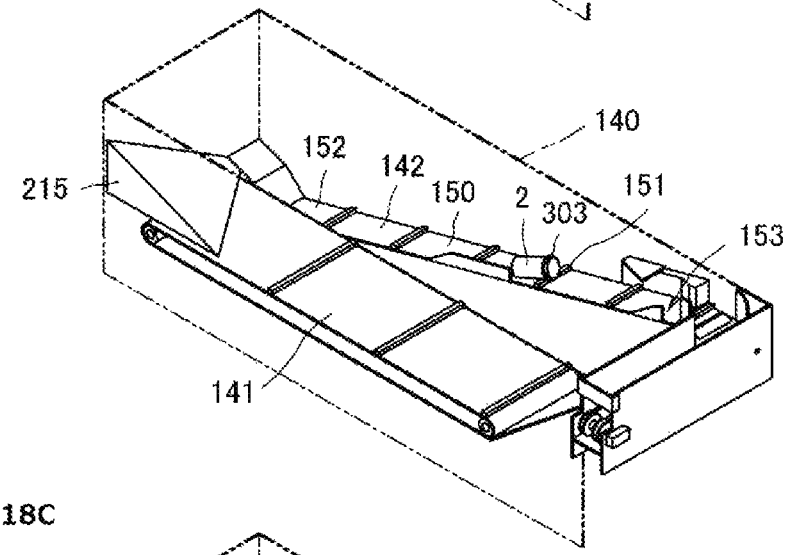

Further, the vial bottle 2 gets on the conveyer belt 150 and reaches the unloaded port portion 153 as shown in FIG. 18B.

Figure 18C:
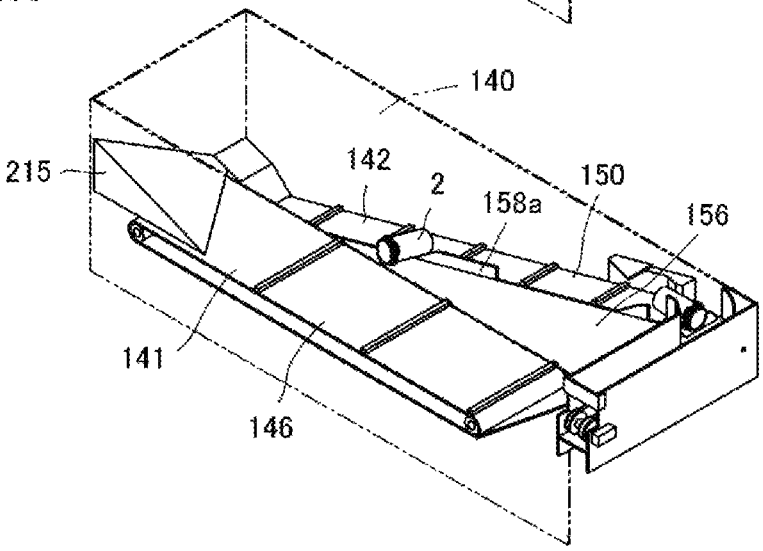
FIG. 18C is a perspective view showing behavior of the vial bottle in a case where posture of the vial bottle is not proper.

In this regard, if the posture of the vial bottle 2 is skewed, the vial bottle 2 gets over the frame 156 in the middle from the loading port portion 152 to the unloading port portion 153 and a part of the vial bottle 2 hits the side portion of the guide wall 158*a*, and thereby the vial bottle 2 falls down to the conveyer belt 146 and returns to the feeding means 141 as shown in FIG. 18C.

Figure 19A:
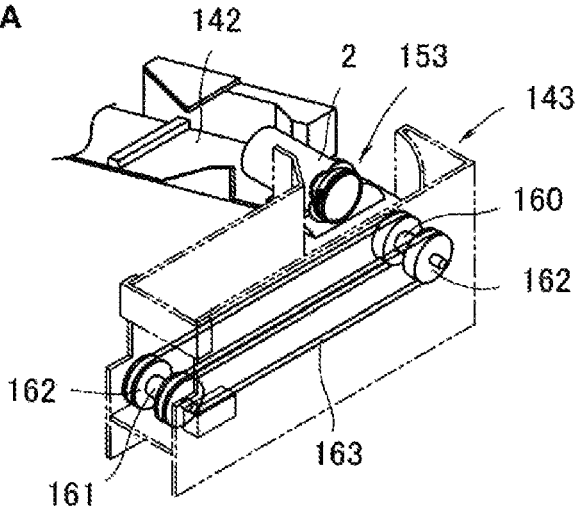
FIGS. 19A to 19C are perspective views for explaining the movement of the vial bottle in turn following to the FIG. 18B.
Figure 19B:
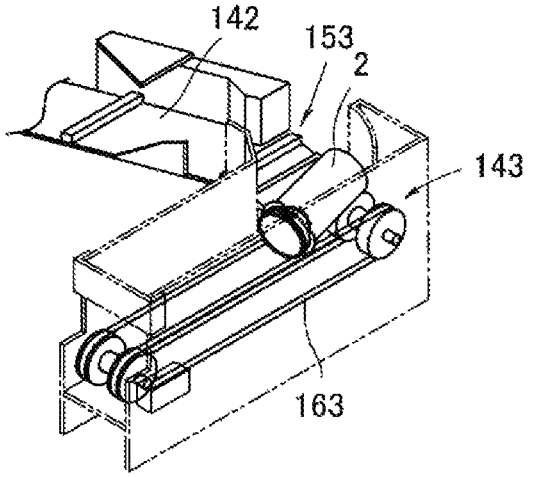
Figure 19C:
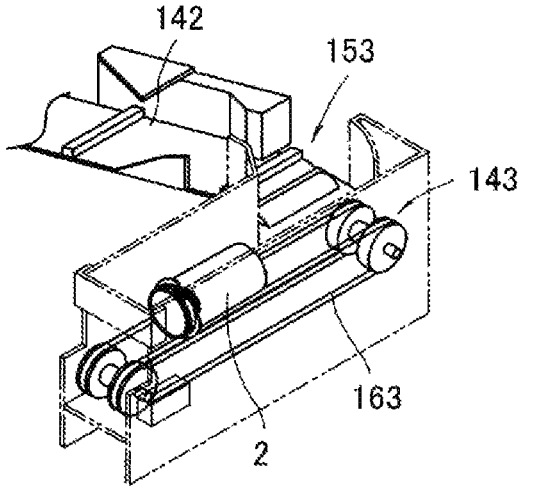

The head portion of the vial bottle 2 which has reached the unloading port portion 153 with the normal posture enters into the transferring means 143 as shown in FIG. 19A and makes contact with the belt 163 to change the direction thereof as shown in FIG. 19B. Then, the vial bottle 2 is pulled into the transferring means 143 by the belt 163 as shown in FIG. 19C and transferred to a predetermined position.

In the empty container transferring device 6 of this embodiment, when the vial bottle 2 is not discharged from the container storing box 140 even if the feeding means 141 and the lifting device 142 have been driven for a predetermined time, the conveyer belt 146 of the feeding means 141 is once run in the reverse direction.

Hereinafter, description will be given to this matter.

The empty container transferring device 6 of this embodiment runs the conveyer belt 146 of the feeding means 141 to the introducing member 215 in the state that the vial bottle 2 is put in the container storing box 140 and runs the conveyer belt 150 of the lifting device 142 from the loading port portion 152 on the bottom side of the container storing box 140 to the unloading port portion 153 on the diagonally upward side.

However, the running path of the feeding means 141 of the container storing box 140 is narrowed toward the head side and the loading port portion 152 of the lifting device 142 is opened to the lateral side of the running path of the feeding means 141.

Thus, there is a case where the amount of the vial bottles taken by the lifting device 142 can not follow the number of the vial bottles 2 transferred in the travelling direction by the feeding means 141 and the vial bottles 2 get in a traffic jam state in the vicinity of the loading port portion 152 of the lifting device 142, and thereby a jam is caused.

In this embodiment, in the case where the vial bottle 2 has not discharged from the container storing box 140 for the predetermined time, there is a possibility that the jam is caused. Thus, the conveyer belt 146 of the feeding means 141 is once run in the reverse direction.

As a result, the vial bottles 2 closing the running path are returned and the jam is solved.

The empty container transferring device 6 of this embodiment is especially suitable for the case of storing the vial bottle 2 having the configuration which has the engaging claw 305 and in which this engaging claw 305 is connected to the holding frame 306 as shown in FIG. 16B.

There is an existing empty container transferring device having a configuration in which the vial bottle 2 is taken by a conveyer taking a vertical posture, for example. Due to the existing empty container transferring device in the prior art, there is a case where excessive force is applied to the holding frame 306 and the holding frame 306 is lacked.

Due to the empty container transferring device 6 of this embodiment, the holding frame 306 is not likely to be damaged.

In this embodiment, the vial bottles 2 are raised on the lifting device 142 in the diagonally upward direction and transferred to the transferring means 143 with being partitioned one by one.

The partition between the preceding vial bottle 2 and the following vial bottle 2 is detected by a sensor (not shown).

Here, if the preceding and following vial bottles 2 are raised on the lifting device 142 in the state that no space exists between them and the preceding and following vial bottles 2 make contact with each other, the sensor cannot detect the partition. Thus, in this embodiment, once the sensor detects the vial bottle 2, the detection of the sensor is stopped or ignored until a time required for passing one vial bottle 2. Further, if the sensor detects the vial bottle 2 after the predetermined idling time has passed, it is determined that the detected vial bottle 2 is the vial bottle 2 following to the preceding vial bottle 2.

Further, in this embodiment, when the vial bottle 2 is not discharged from the container storing box 140 for the predetermined time, the conveyer belt 146 of the feeding means 141 is once run in the reverse direction as described above.

At this time, although the lifting device 142 is stopped and a timer for the detection of the above-mentioned sensor is also stopped, there is a case where the endless body of the lifting device 142 is slightly returned by effects of back-rush of the gears, the clutches and the like. In this case, the vial bottles 2 on the lifting device 142 are also returned. When the lifting device 142 is again driven and the above-mentioned timer keeps counting time in this state, the distance that the vial bottles 2 pass through the sensor portion expands by a returned distance and thus the time required for passing the vial bottle 2 through the sensor portion substantially expands. Thus, when the sensor detects one vial bottle 2 and then the detection of the sensor is re-started after the predetermined time has passed, there is a concern that the same vial bottle 2 is again detected.

Thus, if the sensor actually detects the vial bottle 2 when the lifting device 142 is re-driven, the above-mentioned counting of the idling time is kept with taking the possibility that the vial bottle 2 is returned into account.

In a case where the sensor does not actually detect the vial bottle 2 when the lifting device 142 is re-driven, it is considered that the vial bottle 2 is slid down and the counting of the idling time is stopped. When the sensor newly detects the vial bottle 2, the partition for the vial bottles 2 is determined.

Next, description will be given to detailed devices of the medicine dispensing device 200 and devices recommended to be employed.

(Sealing Checking Device)

It is preferable to contain a device for checking whether or not the resin sheet 88 is properly attached to the opening of the vial bottle 2 and the opening of the vial bottle 2 is sealed.

Figure 20A:
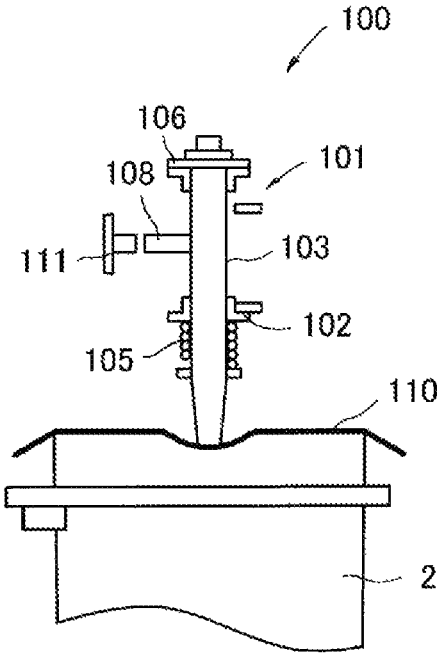
FIGS. 20A and 20B are an explanation view showing operations of a sealing checking device.
Figure 20B:
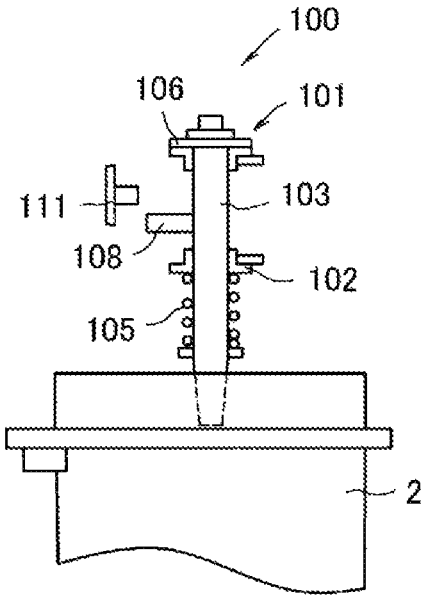

A sealing checking device 100 has a temporary pressing member 101 for pressing the opening portion of the vial bottle 2 after the sealing as shown in FIGS. 20A and 20B and is configured to determine whether or not the sealing is performed from behavior of the temporary pressing member 101.

The temporary pressing member 101 has a holding member 102 and a movable member 103. The movable member 103 is held so that the movable member 103 can move in the axial direction with respect to the holding member 102.

The movable member 103 is biased by a biasing member 105 such as a spring so that its tip end protrudes from the holding member 102.

However, a stopper 106 is provided at the movable member 103 and thus the movable member 103 is not left from the holding member 102.

A dog 108 is provided at the movable member 103 and this dog 108 linearly moves together with the movable member 103.

A sensor 111 for detecting the dog 108 is provided in the vicinity of the temporary pressing member 101.

The sealing checking device 100 of this embodiment relatively approaches the vial bottle 2 to the temporary pressing member 101 as shown in FIGS. 20A and 20B and presses a surface of a sealed sheet 110 with the movable member 103 of the temporary pressing member 101.

If the sheet 110 is attached to the vial bottle without loosening, the movable member 103 moves back against the biasing member 105 as shown in FIG. 20A and the dog 108 attached to the movable member 103 moves, and thereby the sensor 111 detects the dog 108.

Inversely, if the sheet 110 is broken or loosened or if the sheet 110 does not exist, the movable member 103 enters into the vial bottle 2 without resistance as shown in FIG. 20B and the sensor 111 does not detect the dog 108.

Thus, it is possible to detect the condition of the sheet 110 based on whether or not the sensor 111 detects the dog 108.

(Vial Bottle Height Measuring Device)

Figure 21A:
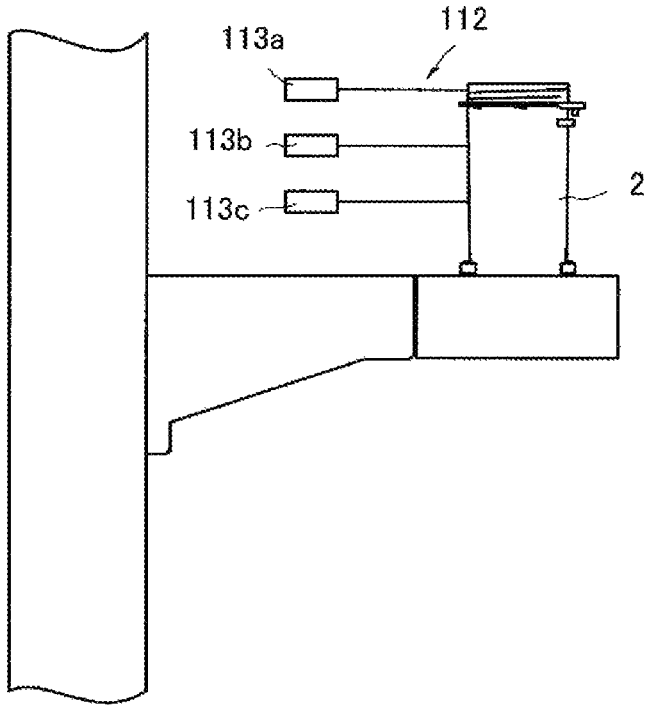
FIGS. 21A and 21B are a front view of a vial bottle height measuring device.
Figure 21B:
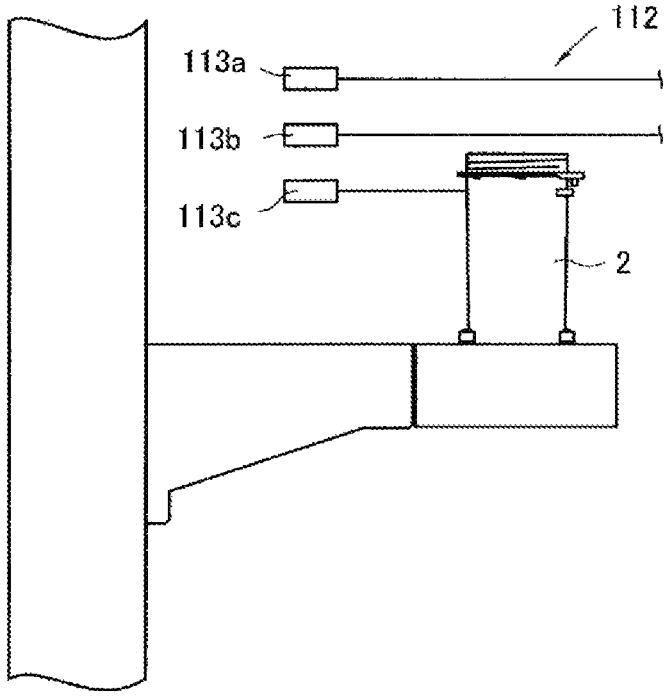

A vial bottle height measuring device 112 shown in FIGS. 21A and 21B is constituted of a plurality of sensors 113*a*, 113*b*, 113*c* respectively arranged at different heights and is configured to detect the vial bottle height whether or not which one of the sensors 113*a*, 113*b*, 113*c* detects the vial bottle 2.

In FIG. 21A, all of the sensors 113*a*, 113*b*, 113*c* detect the vial bottle 2 and it is detected that the vial bottle has high height.

In FIG. 21B, the sensor 113*c* at the lowest position detects the vial bottle 2 and it is detected that the vial bottle has low height.

(Cover Fastening Device)

A vial bottle cover fastening device 120 for attaching a cover to the vial bottle 2 may be provided.

Figure 22:
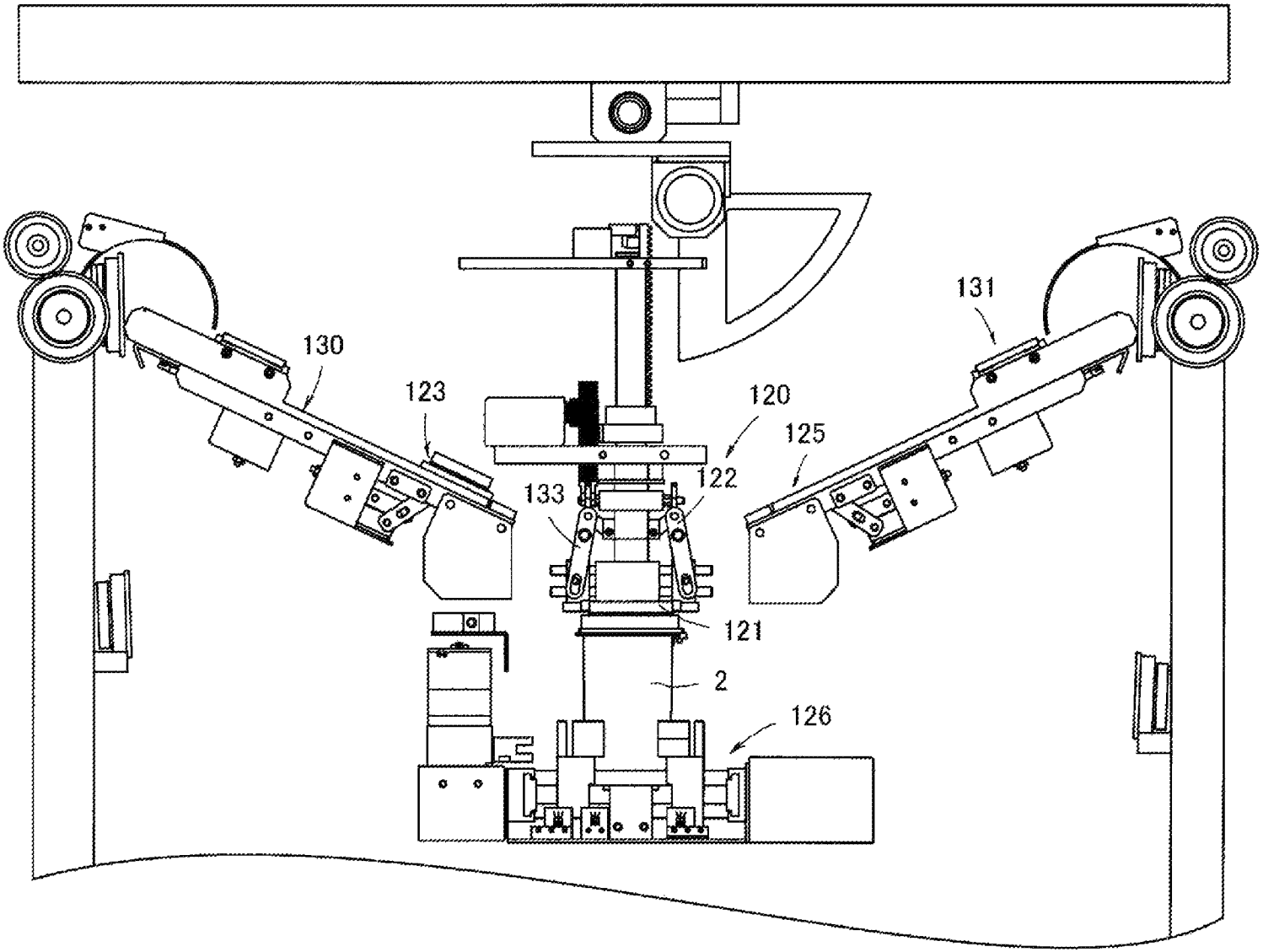
FIG. 22 is a front view of a cover fastening device for attaching a cover to a main body of the vial bottle.

The vial bottle cover fastening device 120 is configured to attach a cover body 121 to the vial bottle 2 filled with the tablets as shown in FIG. 22.

The screw is formed at the opening edge of the vial bottle 2 used in this embodiment. In the same manner, a screw is formed on the cover body 121.

By pressing the cover body 121 onto the opening edge of the vial bottle 2 and rotating the cover body 12, the cover body 121 can be attached to the vial bottle 2.

The vial bottle cover fastening device 120 has one cover rotating device 122, two systems of cover placing member 123, 125 and transferring devices 130, 131 for transferring the cover body 121 to each of the cover placing members 123, 125. Further, the vial bottle cover fastening device 120 includes a holding member 126 for holding the vial bottle 2.

The cover rotating device 122 has a chuck 133 and can hold the cover body 121 and rotate the cover body 121.

The vial bottle cover fastening device 120 holds the vial bottle 2 with the holding member 126 and presses the cover body 121 held by the chuck 133 of the cover rotating device 122 onto the opening of the vial bottle 2.

Then, by rotating the chuck 133 to attach the cover body 121.

Here, in the vial bottle cover fastening device 120 of this embodiment, the chuck 133 is once rotated in a direction in which the screw is loosened after the cover body 121 is pressed onto the opening of the vial bottle 2.

As a result, the vial bottle 2 and the cover body 121 are biased by the engagement between the screws in a direction in which the vial bottle 2 and the cover body 121 move away from each other.

Then, the engagement between the screws of the vial bottle 2 and the cover body 121 is released and the cover body 12 slightly falls down to the side of the vial bottle 2.

The vial bottle cover fastening device 120 of this embodiment detects the event that the cover body 121 slightly falls down to the side of the vial bottle 2 and reversely rotates the chuck 133 with using this event as a trigger to rotate the cover body 121 in a direction for fastening the screws.

As a result, the cover body 121 is straightly fixed to the vial bottle 2 without distortion.

(Medicine Cassette)

The medicine cassette 310 has a solid agent containing portion 320 for containing the tablets and is configured to discharge the tablets in the solid containing portion 320 by a required amount.

It is preferable that the medicine cassette 310 corresponds to tablets and capsule agents having various shapes and structures and can discharge these medicines one by one, or two of more collectively.

Namely, the solid medicines are roughly categorized into the tablets and the capsule agents from a viewpoint of its structure. Further, the shape of the tablet contains a flattened circular shape, an ellipse shape and a spherical shape. The size of the tablet contains various sizes. This can be applied to the capsule agents and the size of the capsule agents contains various sizes. Hereinafter, description will be given with considering the tablet as a target.

The medicine cassette 310 has formation changing means for changing its formation so as to smoothly discharge the tablet depending on the shape of the tablet. Specifically, the medicine cassette 310 is configured to increase and decrease a width of a dispensing path through which the tablet passes to restrict the shape of the tablet which can pass the dispensing path so as to correspond to tablets having different shapes or structures for corresponding to plural types of tablets.

Namely, in order to discharge the tablets one by one, it is required to align the tablets in one line at any position. Here, if the width of the dispensing path is broad, there is a case where the tablets are parallel aligned in some lines and some tablets are collectively discharged. Inversely, if the width of the dispensing path is narrow, the tablet cannot pass through the dispensing path and the tablet cannot be discharged.

Thus, in order to discharge the tablets one by one, it is required to change the size (width) of the dispensing path depending on the contained tablets.

The medicine cassette 310 of this embodiment can arbitrarily adjust a height and the width of the dispensing path for restricting the dispensing path for the tablets. The medicine cassette 310 is configured to discharge the tablets by a required amount without any delay even if the tablets having any shape or any size are put into the solid agent containing portion 320.

Hereinafter, description will be given.

Figure 23:
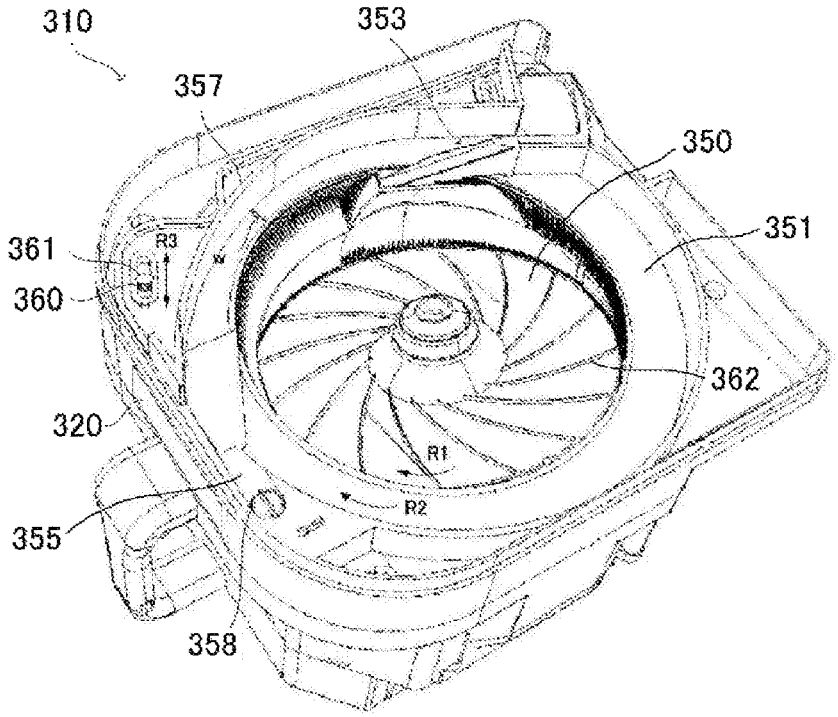
FIG. 23 is a perspective view obtained by observing a medicine cassette employed in the medicine dispensing device shown in FIG. 1 from one direction.
Figure 24:
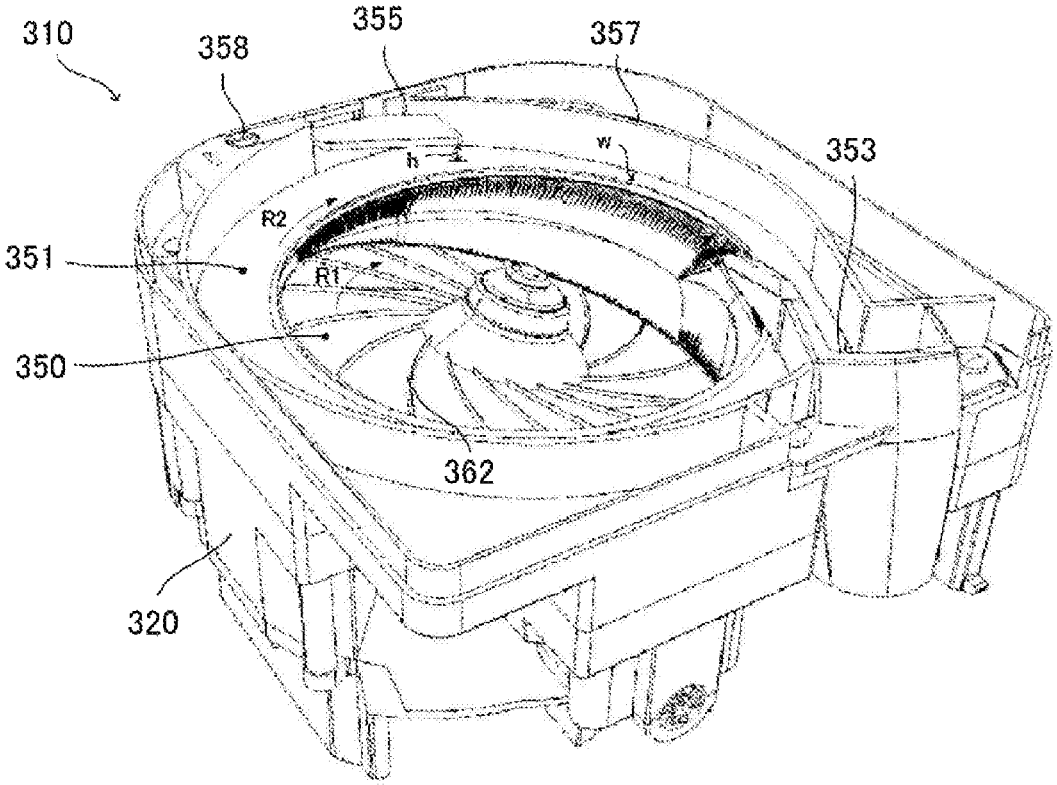
FIG. 24 is a perspective view obtained by observing the medicine cassette shown in FIG. 23 from a direction differing from the direction of FIG. 23.
Figure 25:
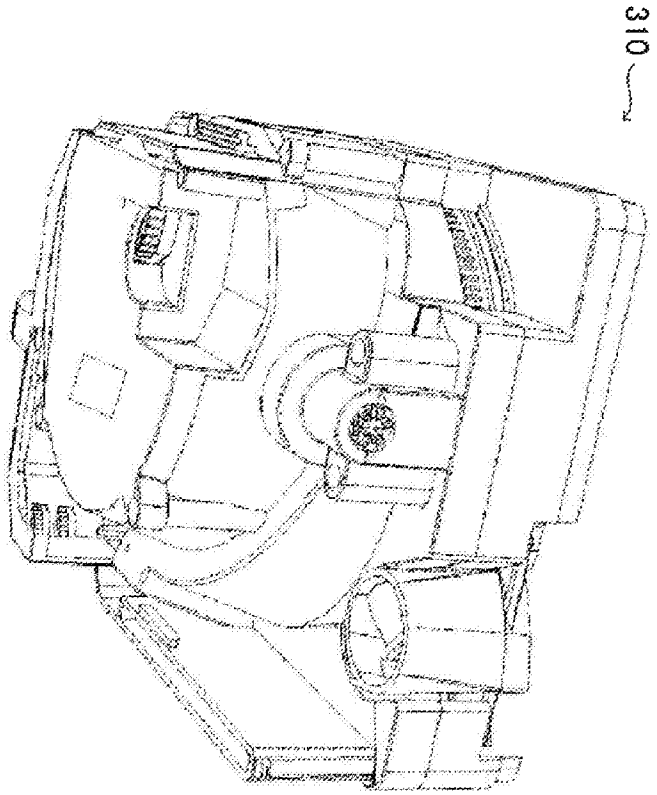
FIG. 25 is a perspective view obtained by observing a solid agent dispensing device shown in FIG. 23.

The medicine cassette 310 has the solid agent containing portion 320 for containing a number of tablets, a first rotating body (an inner rotating body) 350 and a second rotating body (an inner rotating body) 351 as shown in FIGS. 23 and 24.

In this regard, each of FIGS. 23 and 24 is a view in which the cover portion covering the upper portion is omitted.

The first rotating body 350 is a discoid member constituting a bottom surface of the solid agent containing portion 320. A rotational axis of the first rotating body 350 is inclined with respect to the vertical direction by a predetermined angle and thus an upper surface of the first rotating body 350 is inclined with respect to the horizontal plane by the predetermined angle. Further, radial libs 362 are formed on the upper surface of the first rotating body 350 so as to be apart from each other at regular intervals.

The first rotating body 350 is supported by a housing of the medicine cassette 310 so that the first rotating body 350 can rotate and rotated by a motor (not shown). Further, the first rotating body 350 can be raised and lowered.

The second rotating body 351 is a hollow annular member arranged around the first rotating body 350 in the planar view thereof. The second rotating body 351 is positioned on the upper side of the solid agent containing portion 320. An upper end portion of the above-mentioned first rotating body 350 is positioned in the same horizontal plane as the second rotating body 351.

The second rotating body 351 is also supported by the housing of the medicine cassette 310 so that the second rotating body 351 can rotate and rotated by a motor (not shown).

A part of the second rotating body 351 is communicated with a discharging port 353 for discharging the tablets from the solid containing portion 320. Further, the tablets are transferred to the discharging port 353 by the rotation of the second rotating body 351. Thus, an upper portion of the second rotating body 351 serves as a part of the dispensing path through which the tablets pass.

Further, in this embodiment, a height restricting member 355 and a width restricting member 357 are arranged on the dispensing path through which the tablets are transferred to the discharging port 353 by the second rotating body 351.

Here, the height restricting member 355 is positioned above the second rotating body 351 and is configured to restrict a height of an area from a transferring surface of the second rotating body 351. The height restricting member 355 is configured to restrict a height of an object passing through this portion. The height restricting member 355 is configured to restrict the size of the tablet in the height direction, which can be transferred to the discharging port 353 by the second rotating body 351.

On the other hand, the width restricting member 357 is configured to extend from the lateral side of the second rotating body 315 to the area of the second rotating body 351 (the dispensing path) and temporarily narrow the width of the transferring path of the second rotating member 351. The width restricting member 357 restricts the size of the tablet in the width direction, which can be transferred to the discharging port 353 by the second rotating body 351.

With this configuration, in the medicine cassette 310, among the tablets placed on the second rotating body 351, only tablets having a height within a height h restricted by the above-mentioned height restricting member 355 and a width within a width w restricted by the above-mentioned width restricting member 357 are discharged from the discharging port 353. Thus, in the medicine cassette 310, in a case where the height h and the width w coincide with the height and the width of one tablet contained in the solid agent containing portion 320, the tablets can be discharged per one unit.

The above-mentioned width restricting member 357 is supported so that the width restricting member 357 can rotate with respect to the housing of the medicine cassette 310 through a vertical shaft (not shown). Further, a motor (not shown) is driven to pivotally move the width restricting member 357 in the horizontal direction and change a protruding mount of the width restricting member 357 toward the side of the solid agent containing portion 320 (the area of the second rotating member 351), and thereby the width w restricted by the width restricting member 357 is changed.

Namely, the medicine cassette 310 includes a width adjusting member 360 for changing the width w restricted by the width restricting member 357. A pinion gear is formed on an outer peripheral surface of the width adjusting member 360 and engaged with a rack (gear) formed on an inner peripheral surface of an elongated hole 361 formed in the width restricting member 357.

The protruding amount of the width restricting member 357 toward the side of the solid agent containing portion 320 is changed when each of the width adjusting member 360 and the elongated hole 361 is relatively moved in a direction indicated by the arrow R3 (see FIG. 3) by the rotation of the width adjusting member 360.

Further, the medicine cassette 310 has a height adjusting portion 358 for changing the height h restricted by the above-mentioned height restricting member 355.

The height adjusting portion 358 is supported by the housing of the medicine cassette 310 so that the height adjusting portion 358 can rotate. When the height adjusting portion 358 is driven by a motor (not shown), a position of a lower end portion of the height adjusting portion 358 is moved in the vertical direction to change the height h restricted by the height restricting member 355.

In the medicine cassette 310 of this embodiment, the first rotating body 350 and the second rotating body 351 are rotated by the motors (not shown). Further, the first rotating body 350 is raised and lowered in the solid agent containing portion 320. When the tablets in the medicine cassette 310 are discharged, the first rotating body 350 and the second rotating body 351 are rotated. When the first rotating body 350 is rotated in a rotating direction R1 (see FIG. 23 and FIG. 24), the tablets in the solid agent containing portion 320 are discharged from the first rotating body 350 to the second rotating body 351. Further, when the second rotating body 351 is rotated in a rotating direction R2 (see FIG. 23 and FIG. 24), the tablets on the second rotating body 351 are transferred to the discharging portion 353.

However, the dispensing path for the tablets is restricted by the height restricting member 355 and the width restricting member 357 and thus the height and the width are restricted. Thus, among the tablets transferred by the second rotating body 351, the tablets stacked in the height direction make contact with the height restricting member 355 and are returned to the solid agent containing portion 320. Further, among the tablets transferred by the second rotating member 351, the tablets transferred with being aligned side by side make contact with the width restricting member 357 and are returned to the solid agent containing portion 320.

Thus, in the medicine cassette 310 of this embodiment, the tablets having the height and the width corresponding to the height h restricted by the height restricting member 355 and the width w restricted by the width restricting member 357 are transferred to the discharged port 353 in a state that the tablets are aligned on the second rotating body 351 in the circumferential direction one by one. Thus, the medicine cassette 310 can dispense the tablets contained in the solid agent containing portion 320 one by one and thus control the amount of the dispensed tablets.

In the medicine cassette 310 of this embodiment, the first rotating body 350 located on the inner side is rotated and slowly raised to rotate and raise a tablet group placed on the first rotating body 350. Then, when a height of an upper portion of the tablet group reaches a height of the second rotating body 351 located on the outer side and a falling sensor (not shown) detects the tablets, the raising of the first rotating body 350 is stopped and the first rotating body 315 is rotated at this height to supply the tablets to the second rotating body 351 located at the outer side. Since the second rotating body 351 located on the outer side keeps rotating, the tablets on the second rotating body 351 are transferred toward the discharging port 353.

For example, it is preferable that master data for each medicine is stored in the control device 230 of the medicine dispensing device 200 or a host control device and shape information (size) of each medicine is preliminarily registered in this master data. At least information on the length (total length) of each medicine is stored in the master data.

When the tablets are put into the solid containing portion 320 of the medicine cassette 310, the information on the shape of the medicine stored in the above-mentioned master data is obtained.

Then, the formation changing means is activated based on the obtained shape information of the medicine and the height and the width of the dispensing path are adjusted. Further, an appropriate dispensing speed is decided. In this embodiment, an initial rotational speed of the second rotating body 351 is decided based on the information on the length (total length) of the medicine.

If the solid medicines contained in the solid agent containing portion 320 are medicines having a shape like an elongated capsule or a large-diameter discoid shape, the initial rotational speed of the second rotating body 351 is fast. In contrast, if the medicines are small, the initial rotational speed of the second rotating body 351 is slow.

In this embodiment, the second rotating member 351 is rotated with the initial rotational speed and the tablets are transferred from the solid agent containing portion 320 to the discharging port 353 and discharged to the outside.

Then, an actual discharging timing of the medicine is detected. Namely, it is not preferable that the tablets are discharged from the medicine cassette 310 in a state that the tablets are continued to each other. Inversely, it is not preferable that a space between the adjacent tablets is too large.

In this embodiment, the second rotating body 351 is rotated with the initial rotational speed, actual intervals of discharging the tablets are observed and the rotational speed of the second rotating body 351 is corrected from the initial rotational speed so that the intervals for the discharging become an appropriate value. After that, the second rotating body 351 is rotated with the corrected rotational speed to discharge the tablets from the medicine cassette 310.

The corrected rotational speed of the second rotating body 351 is stored in the control device 230 or the master data. After that, when the same type of the medicines is discharged, the second rotating body 351 is rotated with the stored rotational speed.

It is preferable that the height and the width of the dispensing path are corrected in addition to the rotational speed of the second rotating body 351. Namely, it is preferable that the actual intervals of discharging the tablets are observed and the size of the dispensing path is corrected so that the discharging intervals become an appropriate value. The corrected size of the dispensing path is also stored in the control device 230 or the master data. After that, it is preferable that when the same type of the medicines is discharged, the height and the width are adjusted to the stored height and the stored width and then the tablets are discharged.

On the other hand, when the shape information of the medicine does not exist in the master data, the formation changing means is activated to find out an appropriate size of the dispensing path. Specifically, the dispensing path (the width and the height) is broadened in a phased manner to find out the width of the path through which the tablet can pass and decide the size of the path. Further, information on the dispensing path at this time is stored in the master data as the shape information and the formation changing means is controlled with reference to this information at next and succeeding times.

When the master data itself does not exist or means for storing the master data does not exist, the above-mentioned operation for finding out the appropriate size of the dispensing path is performed every time when the tablets are put into the medicine cassette 310.

As one modified example, an appropriate raised position of the first rotating body 350 may be computed from the size of the solid agent containing portion 320 and the remaining amount of the tablets contained in the solid agent containing portion 320 and the first rotating body 350 may be raised to this height at once.

Further, once the tablets are discharged, the first rotating body 350 located on the inner side may not be lowered and may be stopped at this height for preparing a next discharging request.

When the medicine cassette 310 is removed from the container attachment portion 240 of the medicine supplying part 203, the first rotating body 350 located on the inner side is lowered to the lowest height.

When the discharging request for the tablets is received after the tablets have been re-filled into the solid agent containing portion 320 and the medicine cassette 310 has been again attached to the container attachment portion 204, the above-mentioned processes are repeated and the tablets are moved from the first rotating body 350 being rotating to the second rotating body 351 being rotating, and thereby the tablets on the second rotating body 351 are transferred to the discharging port 353.

As one modified example, when the medicine cassette 310 is again attached to the container attachment portion 204, only the first rotating body 350 may be rotated and raised in a state that the rotation of the second rotating body 351 is stopped and the first rotating body 350 may be idled at a predetermined height.

For example, when the medicine cassette 310 is again attached, the first rotating body 350 located on the inner side is rotated and raised without waiting the discharging request for the tablets and the falling sensor detects the tablets, the raising of the first rotating body 350 is stopped. Since the second rotating body 351 is not rotated, the tablets are not discharged from the discharging port 353.

(Medicine Transferring Device)

The medicine transferring device 212 is arranged in the medicine dispensing device 200.

The medicine transferring device 212 is arranged on the rear side of the medicine supplying part 203 as shown in FIGS. 26A to 26E and has a movable head 400.

The movable head 400 moves in the rear side of the medicine supplying part 203 along a rail (not shown) in the lengthwise direction (X direction) of the medicine dispensing device 200. Further, the movable head 400 is held by a raising and lowering device (not shown) and also moves in the vertical direction (Y direction).

Namely, the movable head 400 is held by an X-Y table of sorts and horizontally moves in the rear side of the medicine supplying part 203.

Further, the movable head 400 also moves with respect to the rear surface of the medicine supplying part 203 in the approaching and moving away direction.

Figure 27:
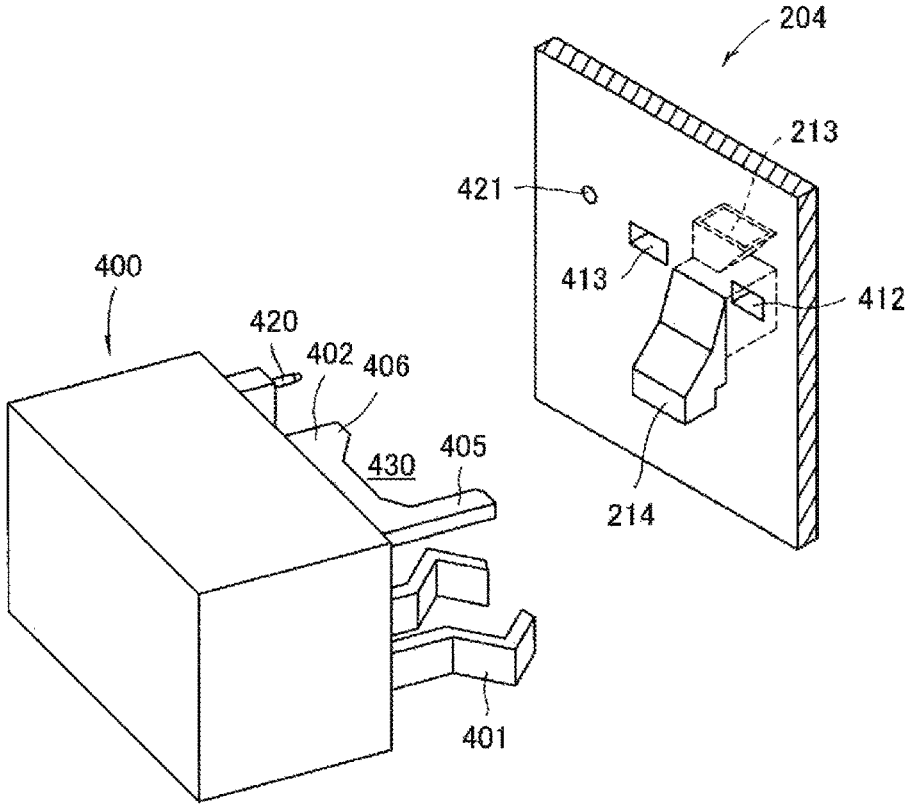
FIG. 27 is a configuration diagram of the movable head and a part on the rear side of the medicine supplying part.
Figure 28:
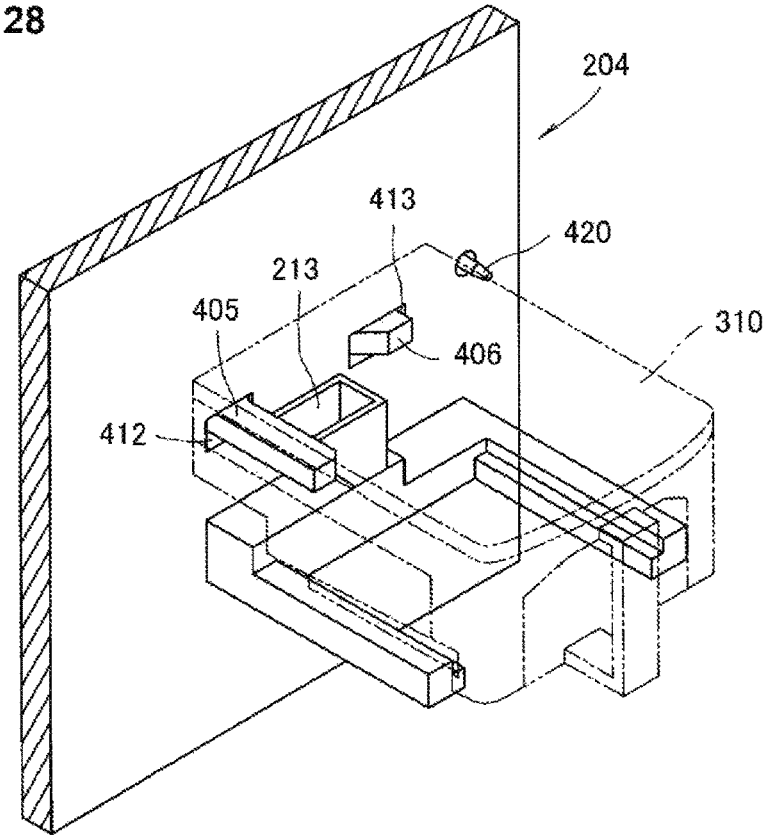
FIG. 28 is a partially-enlarged view of an outer side of the medicine dispensing device shown in FIG. 1 and shows a container attachment portion of the medicine supplying part.

The movable head 400 includes a chuck 401 for holding the vial bottle 2 and a medicine counting substrate (medicine counting means) 402 as shown in FIG. 27.

Figure 29:
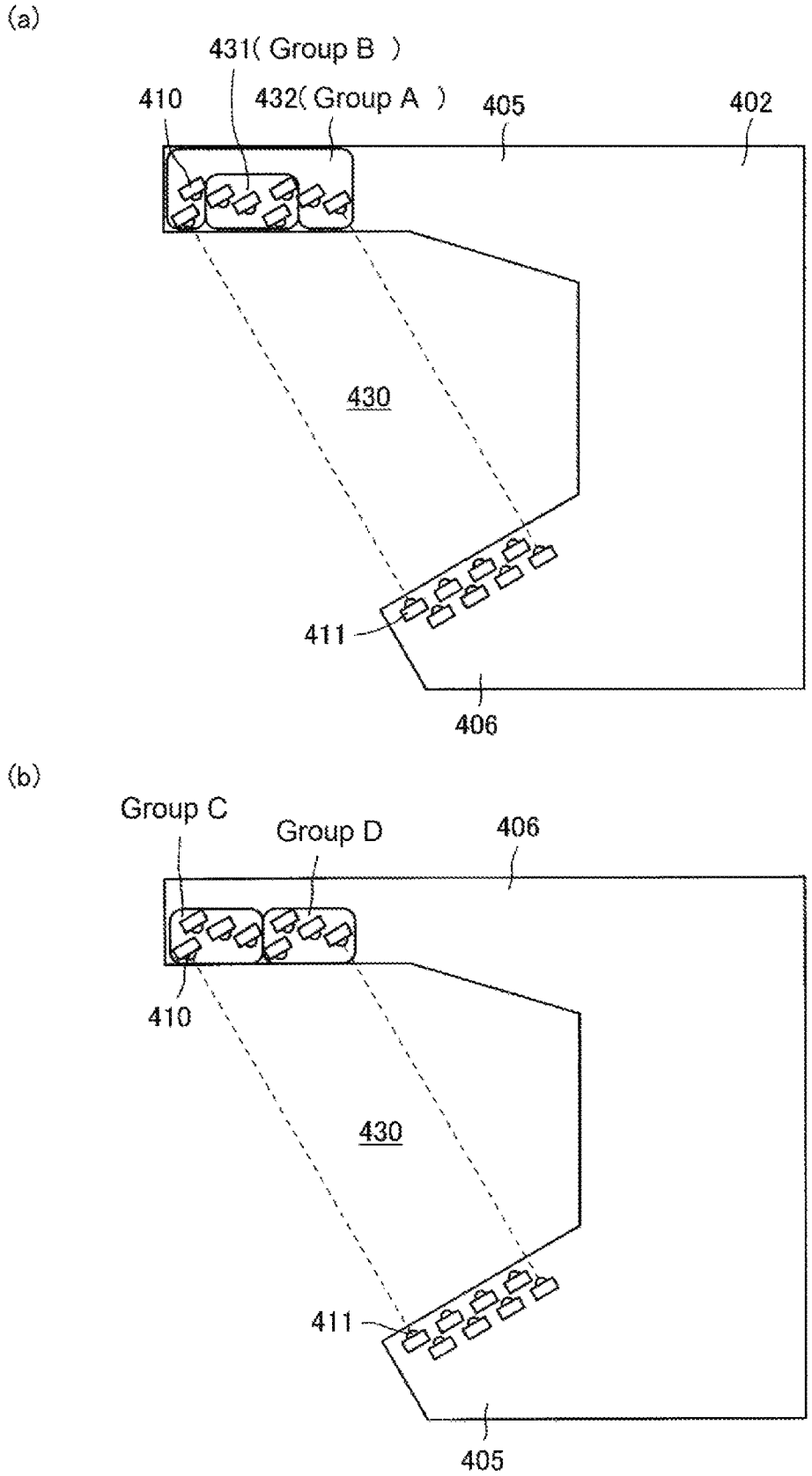
FIGS. 29A and 29B are configuration diagrams showing arrangement of light emitting members and light receiving members of medicine counting means.

The medicine count substrate 402 has two arm member 405, 406 as shown in FIG. 27 and FIGS. 29A and 29B and is configured to count the number of the tablets passing between the arm members 405, 406 with an optical sensor.

The arm member 405 on one side is a light emitting side arm and a plurality of light emitting elements 410 are arranged as shown in FIG. 29A.

The arm member 406 on the other side is a light receiving side arm and a plurality of light receiving elements 411 are arranged as shown in FIG. 29A.

The plurality of light emitting elements 410 and the plurality of light receiving elements 411 are respectively provided at the two arm members 405, 406 respectively arranged positions apart from each other and a predetermined distance exists between the plurality of light emitting elements 410 and the plurality of light receiving elements 411.

The medicine counting substrate 402 is configured to detect an event that light receiving of the light receiving elements 411 is stopped when the tablet passes through a horizontal space 430 surrounded by the light emitting elements 410 and the light receiving elements 411 and the tablet interrupts light from the light emitting elements 410 and count the amount of the medicines passing through the horizontal space 430.

In this embodiment, eight light emitting elements (light emitting members) 410 are attached to the light emitting side arm member. Eight light receiving elements (light receiving members) 411 are attached to the light receiving side arm member 406.

In this embodiment, the eight light emitting elements 410 are grouped into two light emitting element groups 431, 432 as indicated by surrounding frames. Among the eight light emitting elements 410, total four light emitting elements 410 containing the two light emitting elements 410 at positions closed to an opened end side of the light emitting side arm member 405 and the two light emitting elements 410 at positions closed to a base end side of the light emitting side arm member 405 constitute a group A. Further, the four light emitting elements 410 arranged at positions closed to the center constitute a group B.

Further, in this embodiment, light emitting amounts of the light emitting elements 410 are controlled for each group. Namely, the four light emitting elements 410 belonging to the group A emit the light with the same light emitting amount. Further, the four light emitting elements 410 belonging to the group B emit the light with the other same light emitting amount.

The number of the light emitting elements 410 and the number of the groups are arbitrary and it can be said that these numbers are preferably large.

As a method of grouping, although ones at portions closed to the opened end side may be grouped as a group C and ones at positions closed to the base end side may be grouped as a group D as shown in FIG. 29B, it is preferable that ones at positions close to the center side is grouped as another group as shown in FIG. 29A.

The reason for this matter is that light receiving conditions are different from the light receiving elements 411 corresponding to the light emitting elements 410 arranged on the center side and the light receiving elements 411 corresponding to the light receiving elements 410 arranged on the end side.

Namely, the light emitted from the light emitting elements 410 diffuses and the light receiving elements 411 corresponding to the light emitting elements 410 on the center side receive not only the light emitted from the light emitting elements 410 on the center side but also the light emitted from the light emitting elements 410 on the both sides. On the other hand, the light receiving elements 411 on the end side are not likely to receive effect of the other light emitting elements 410.

In order to average the light receiving amounts of the light receiving elements 411, it is preferable that the light emitting amounts of the light emitting elements 410 arranged on the center side are set to be different from the light emitting amounts of the light emitting elements 410 arranged on the end side and the light emitting amounts of the light emitting elements 410 arranged on the center side are suppressed compared with the light emitting amounts of the light emitting elements 410 arranged on the end side. Thus, it is preferable that the grouping for the light emitting elements 410 is performed so that the light emitting elements 410 on the center side are grouped as a group other than a group of the light emitting elements 410 on the end side as shown in FIG. 29A.

As shown in FIGS. 26A to 26E, a plurality of medicine dispensing ports 214 are provided on the rear side of the medicine supplying part 203 so as to correspond to the container attachment portions 204 on the front side.

Further, each of the container attachment portions 204 of the medicine supplying part 203 has a medicine supplying port 213 communicating with the above-mentioned medicine dispensing port 214.

The above-mentioned medicine cassette 310 is arranged at the container attachment portion 204 on the front side and the tablets are discharged from the medicine cassette 310 to the medicine dispensing port 214.

Two openings 412, 413 passing through from the front side to the rear side are formed in the wall surface of the medicine supplying part 203.

Further, the arm members 405, 406 of the above-mentioned medicine counting substrate 402 are respectively inserted into the openings 412, 413 from the rear side of the medicine supplying part 203 and these arm members 405, 406 can respectively pass through the openings 412, 413 and protrude toward the front side of the medicine supplying part 203.

Namely, the movable head 400 can move with respect to the rear surface of the medicine supplying part 203 in the approaching and moving away direction and can move the movable head 400 to the side of the wall surface of the medicine supplying part 203 for allowing the arm members 405, 406 to protrude from the openings 412, 413 toward the front side.

Further, the two arm members 405, 406 protrude at positions covering the medicine supplying port 213 and the medicines discharged from the medicine cassette 310 pass through the space 430 surrounded by the two arm members 405, 406 are counted when the medicines fall down into the medicine supplying port 213.

In this embodiment, the light emitting elements 410 and the light receiving elements 411 are respectively provided at the two arm members 405, 406. In actuality, these elements are arranged in spaces partitioned by transparent plates such as glass.

Here, there is a case where the transparent plates for partitioning the spaces from the outside get dirty due to powder dusts of the medicines. Thus, the light receiving amounts of the light receiving elements 411 in the idling state that the tablet does not pass is checked. If the light receiving amounts are lower than a predetermined threshold value, it is determined that the transparent plates get dirty and indication for facilitating cleaning of the transparent plates is displayed.

Here, it is preferable that the threshold value for displaying the indication facilitating the cleaning contains a threshold value in a case where the arm members 405, 406 are contained on the rear side of the medicine supplying part 203 and a threshold value in a case where the arm members 405, 406 protrude toward the front side.

Further, a method of providing a cleaning tool such as a rubber and a brush at the openings 412, 413 and wiping the surfaces of the transparent plates when the two arm members 405, 406 respectively pass through the openings 412, 413 to drop dusts from the surfaces of the transparent plates.

The movable head 400 holds the vial bottle 2 with the chuck 401 and moves on the rear side of the medicine supplying part 203 in the lengthwise direction (X direction) of the medicine dispensing device 200. Further, the movable head 400 moves in the vertical direction (Y direction) and stops at the rear surface of the container attachment portion 204 to which the tablets should be discharged.

Here, a stop position of the movable head 400 is set by controlling a motor (not shown) with a pulse-control. Namely, the movable head 400 is moved in the linear direction by an amount of predetermined pulses and moved in the vertical direction by an amount of predetermined pulses to stop the movable head 400 at the rear surface of the target container attachment portion 204.

Here, in this embodiment, a function of automatically performing an initial setting for the moving amount (the number of the pulses) of the above-mentioned movable head 400 is provided.

In this embodiment, a reflection-type optical sensor 420 is provided at the movable head 400. Further, a sensor target 421 is provided on the rear surface of each of the container attachment portion 204 as shown in FIGS. 26 and 27.

In the initial setting, the movable head 400 is approached to the position roughly close to the container attachment portion 204 and then the movable head 400 is moved from this position in the lengthwise direction and the vertical direction by a small distance to find out the sensor target 421 as shown in FIG. 26B.

Then, when the optical sensor 420 detects the position of any one of the sensor targets 421 as shown in FIG. 26B, the movable head 400 is moved in the horizontal direction as shown in FIG. 26C to find out positions of right-left end portions of the sensor target 421 at this height. Next, a position of a center line is computed from the moving amount of the movable head 400 in the right-lift direction and the movable head 400 is moved to a position in which the optical sensor 420 detects the center line of the sensor target 421 as shown in FIG. 26C.

Then, the movable head 400 is moved in the vertical direction at this horizontal position to detect end portions of upper and lower end portions of the sensor target 421 as shown in FIG. 26D. Subsequently, the movable head 400 is moved so that the optical sensor 420 detects the positions of the upper and lower end portions of the sensor target 421.

This position of the movable head is stored as a position of a specific container attachment portion 204. Then, these operations are performed to each of the container attachment portions 204 and positions of all of the container attachment portions 204 are stored.

When the medicine dispensing device 200 is used in actuality, stored position information is read to control the motor with the pulse control for moving the movable head 400 to the position of the required container attachment portion 204 without depending on the detection of the sensor target 421.

The above-mentioned initial setting is performed when the medicine dispensing device 200 is shipped or arranged in a drug store or the like, it is unnecessary to frequently perform the initial setting.

However, when any abnormality causes, the above-mentioned initial setting is manually or automatically performed.

For example, it is preferable that in a case where the arm members 405, 406 of the medicine counting substrate 402 do not smoothly enter into the openings 412, 413 while the medicine dispensing device 200 is used, predetermined indication is performed and the above-mentioned initial setting is manually or automatically performed.

(Others)

The driving force transmission and the raising and lowering mechanisms in each device described above are not limited to the embodiment. For example, the raising and lowering mechanisms and the moving mechanisms may employ raising and lowering mechanisms and traversing mechanisms by running a belt, a chain, a wire or the like. For example, as a mechanism for holding the vial bottle or approaching the measuring members to the vial bottle, the raising and lowering mechanisms and the traversing mechanisms by running a belt, a chain, a wire or the like may be employed. Further, a screw mechanism may be employed.

Prescription information is inputted to the medicine dispensing device 200 from a host control device or an input device (not shown). The prescription information is treated in the order of inputting as a general rule and predetermined tablets are filled into the vial bottle 2.

However, in a case where the tablets in the medicine cassette 310 attached to the container attachment portion 204 lack and all of prescription which have been inputted cannot be treated, it is recommended that the treatment for the prescription containing the lack tablets is postponed. Specifically, it is preferable that programming is carried out so that the treatment for the prescription containing the lack tablets is performed after the treatment for the prescription whose tablets do not lack is performed.

Further, in the case where the situation that all of the prescription which have been inputted cannot treated causes, it is preferable that a message indicating this situation is displayed on the monitor screen 221 or the like.

The vial bottle 2 filled with the tablets is held by a robot hand, a chuck of simple transferring means or the like and discharged to the storage shelf 220 of the medicine dispensing device 200. Here, the robot hand and the chuck may be one set or plural sets. With the configuration having the plural sets of the robot hands and the chucks, it is possible to wait by holding the vial bottle 2 with the robot hand or the like in the medicine dispensing device 200 in a case where the storage shelf 220 is fully filled, and thereby it is possible to improve the number of processed requests and a processing speed.

The input of the prescription with respect to the medicine dispensing device 200 is performed by inputting the prescription from a terminal device before a doctor or the like. Matters inputted by the doctor contain a prescription number for identifying the prescription. The prescription number is encoded by a barcode (this is referred to as a prescription barcode), for example.

Further, there is a case where a barcode for identifying the prescription is attached to a label or the like (this is referred to as a barcode of a label).

Information on the medicines stocked in the medicine supplying part 203 is also inputted to the medicine dispensing device 200. The information on the medicines is inputted by reading a barcode (this is referred to as a medicine barcode) attached on a label of an original bottle for the medicines.

The medicine dispensing device 200 according to this embodiment has a barcode reader and can read the above-mentioned barcodes. Thus, by analyzing contents of the barcode with the control device (not shown), the medicine dispensing device 200 determines whether the read barcode is the prescription barcode, the barcode of the label or the medicine barcode described above. A related indication screen is displayed on the monitor screen 221 which is the displaying part.

What is claimed is:

1. A medicine dispensing device for dispensing a medicine container in which medicines are filled, the medicine dispensing device having a container stocking portion for stocking a plurality of medicine containers, a medicine supplying part for supplying solid medicines, and a container taking means for taking the container from the container stocking portion, wherein the medicine supplying part is further configured for filling the medicine container with the solid medicines, the medicine dispensing device comprising:

a container checking means for checking a type of the medicine container, and an outer periphery holding member for holding an outer peripheral portion of the medicine container, wherein the container checking means has posture keeping means for keeping a constant posture of the medicine container and a measuring member which can approach to and move away from the medicine container, wherein the container checking means can check the type of the medicine container by holding the medicine container with keeping the constant posture by using the posture keeping means and allowing the measuring member to approach to the medicine container from a remote position and make contact with the medicine container, wherein the outer periphery holding member has an outer diameter measuring member which can approach to and move away from the outer peripheral portion of the medicine container, and wherein the medicine dispensing device can check the type of the medicine container by allowing the outer diameter member to approach to the medicine container from the remote position and make contact with the outer peripheral portion of the medicine container.

2. The medicine dispensing device claimed in claim 1, wherein the measuring member is a height measuring member and the height measuring member is approached to the medicine container from the remote position so that the height measuring member makes contact with one end of the medicine container.

3. The medicine dispensing device claimed in claim 2, wherein the height measuring member has a protruding portion protruding toward the side of the medicine container, and wherein the height measuring member can check difference between an opening side and a bottom side of the medicine container depending on whether or not the protruding portion makes contact with the medicine container by holding the medicine container with keeping the constant posture by using the posture keeping means and allowing the height measuring member to approach to the medicine container from the remote position and make contact with the medicine container.

4. The medicine dispensing device claimed in claim 1, further comprising a plurality of detection sensors respectively arranged at positions apart from the side of one end of the medicine container toward a height direction of the medicine container, wherein the medicine dispensing device can check a height of the medicine container from detecting status of the detection sensors.

5. The medicine dispensing device claimed in claim 1, further comprising an installation base on which the medicine container taken by the container taking means and position correcting means for correcting a position of the medicine container placed on the installation base to a normal position, wherein a bottom portion of the medicine container is placed on the installation base, wherein the position correcting means has holding means constituted of a plurality of holding pieces, wherein each of the plurality of holding pieces has a concave portion which can make contact with the outer peripheral portion of the medicine container, wherein a central portion of an area surrounded by each of the concave portions substantially coincides with a central portion of the medicine container arranged at a normal set position in a state that the holding pieces move or change their postures and each of the holding pieces moves to an approaching and moving away direction and thereby the holding pieces approach to each other, wherein the holding pieces of the position correcting means move in the approaching direction after the medicine container has been placed on the installation base and thereby the concave portions make contact with the outer peripheral portion of the medicine container to shift the position of the medicine container for correcting the position of the medicine container to the normal position, and wherein after the position of the medicine container has been corrected, the holding pieces move away from the outer peripheral portion of the medicine container and leave from the outer peripheral portion of the medicine container.

6. The medicine dispensing device claimed in claim 1, further comprising a container inside photographing camera for photographing an inside of the medicine container in a state that the medicines are filled in the medicine container, wherein the medicine dispensing device has a focus correcting function of correcting focus of the container inside photographing camera based on the amount of the medicines filled in the medicine container.

7. The medicine dispensing device claimed in claim 1, wherein the medicine container has an opening portion, wherein the medicine dispensing device further comprises a sealing device for covering the opening portion with a sheet, wherein the sealing device has sheet delivering means for delivering the sheet by a required amount from a longitudinal sheet, a plurality of heat-sealing heads and a movable table on which the plurality of heat-sealing heads are placed, and wherein suitable one of the heat-sealing heads is selected based on an opening diameter of the medicine container, the movable table is driven to move the selected heat-sealing head to the vicinity of the medicine container and then the sheet is put between the selected heat-sealing heat and the opening portion of the medicine container for attaching the sheet to the opening portion of the medicine container.

8. The medicine dispensing device claimed in claim 1, wherein the medicine container has an opening portion, wherein the medicine dispensing device further comprises a sealing device for covering the opening portion with a sheet and sealing checking means, and wherein the sealing checking means has a temporary pressing member for pressing the opening portion of the medicine container after sealing and determines whether or not the sealing is performed based on behavior of the temporary pressing member.

9. The medicine dispensing device claimed in claim 1, further comprising a labeling device for attaching a label on which predetermined matters are written to the medicine container, wherein the labeling device has a label printing part and base paper supplying means for supplying label paper to the label printing part, wherein each piece of the label paper is stripped off from a paper roll constituted of a longitudinal release sheet to which a number of pieces of label paper adhere, wherein the base paper supplying means has a delivering side attachment shaft to which a paper roll in a state of having the label paper is attached and a rolling side attachment shaft for rolling the release sheet after the label paper has been stripped off, and wherein a core which can change a diameter of at least one of the delivering side attachment shaft and the rolling side attachment shaft can be attached to the at least one of the delivering side attachment shaft and the rolling side attachment shaft.

10. The medicine dispensing device claimed in claim 1, further comprising a labeling device for attaching a label on which predetermined matters are written to the medicine container, wherein the labeling device has a label printing part and base paper supplying means for supplying label paper to the label printing part, wherein each piece of the label paper is stripped off from a paper roll constituted of a longitudinal release sheet to which a number of pieces of label paper adhere, wherein the base paper supplying means has a delivering side attachment shaft to which a paper roll in a state of having the label paper is attached and a rolling side attachment shaft for rolling the release sheet after the label paper has been stripped off, and wherein the delivering side attachment shaft is rotated within a predetermined range of force by driving force.

11. The medicine dispensing device claimed in claim 1, further comprising a labeling device for attaching a label on which predetermined matters are written to the medicine container, wherein the labeling device has a label printing part, base paper supplying means for supplying label paper to the label printing part and label stripping means, wherein each piece of the label paper is stripped off from a label sheet constituted of a longitudinal release sheet to which a number of pieces of label paper adhere, wherein the label sheet is delivered from a paper roll rolled in a roll shape to the label printing part through a predetermined label supplying path, and wherein a pressing member for pressing one side of the label sheet facing an outer side of the paper roll to warp the label sheet toward a direction opposite to a curl direction of the paper roll is provided at an upper stream position than the label stripping means in the label supplying path.

12. The medicine dispensing device claimed in claim 1, wherein the medicine container has a main body portion and a cover, wherein a screw is provided on the cover of the main body, wherein the medicine dispensing device further comprises a cover attaching device for attaching the cover to the medicine container, and wherein the cover attaching device once rotates the cover in an opening direction after pressing the cover onto an opening portion of the main body portion of the medicine container and then rotates the cover in a fastening direction.

13. The medicine dispensing device claimed in claim 1, wherein the container stocking portion has a container storing box including a storing space for storing the container and a lifting device for taking the container from the container storing box, wherein the lifting device has an endless member, wherein the endless member has an engaging portion engaged with the container, wherein the lifting device has a loading port portion arranged in the vicinity of a bottom portion of the container storing box and an unloading port portion provided on the upper side, wherein one surface of the endless member runs from the loading port portion toward the unloading port portion, wherein feeding means which can move the container in the storing space in one direction is provided on an inside bottom portion of the storing space, wherein the loading port portion of the lifting device is located on the lateral side of the feeding member in the vicinity of an end of a feeding direction of the container in the storing space, and wherein an introducing member for changing a moving direction of the container to introduce the container to the loading port portion is provided in the vicinity of the end of the feeding direction of the container in the storing space.

14. The medicine dispensing device claimed in claim 1, wherein further comprising a medicine cassette and storage means in which information on a length of the medicine is stored, wherein the medicine cassette is arranged at the medicine supplying part, wherein the medicine cassette has a solid agent containing portion for containing the solid medicines, a discharge port for discharging the solid medicines from the solid agent containing portion and a rotating body and is configured to rotate the rotating body to move the solid medicines to the discharging port, and wherein a rotational speed of the rotating body is decided based on the length of the medicine stored in the storage means.

15. The medicine dispensing device claimed in claim 1, wherein the medicine supplying part contains a medicine cassette and medicine counting means, wherein the medicine cassette has a solid agent containing portion for containing the solid medicines and is configured to discharge the solid medicines in the solid agent containing portion one by one, wherein the medicine counting means is configured to count the number of the solid medicines discharged from the medicine cassette and has a plurality of light emitting members arranged so as to be separated from each other by a predetermined distance and a plurality of light receiving members, and wherein the plurality of light emitting members are grouped into a plurality of emitting member groups and light emitting amounts of the plurality of light emitting members are controlled for each emitting member group.

* * * * *